US011041318B1

(12) United States Patent
Mason et al.

(10) Patent No.: US 11,041,318 B1
(45) Date of Patent: Jun. 22, 2021

(54) LOAD TRANSFER PLATE APPARATUS

(71) Applicant: Illinois Tool Works Inc., Glenview, IL (US)

(72) Inventors: Greg Stephen Mason, Rochedale South (AU); David Graham Barnes, Manly (AU)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/723,010

(22) Filed: Dec. 20, 2019

(51) Int. Cl.
*E04F 15/14* (2006.01)
*E01C 11/08* (2006.01)

(52) U.S. Cl.
CPC ..... *E04F 15/14* (2013.01); *E01C 11/08* (2013.01)

(58) Field of Classification Search
CPC ..... E04F 15/14; E01C 11/08; E01C 11/14; E01C 19/504; E04B 14/83; E04B 2005/324; E04B 5/32
See application file for complete search history.

(56) References Cited

U.S. PATENT DOCUMENTS 2,094,853 A * 10/1937 Shaw ..... E01C 11/14 404/56
2,181,005 A * 11/1939 Westcott ..... E01C 11/14 404/60
2,316,233 A * 4/1943 Fischer ..... 404/60
2,349,983 A * 5/1944 Musall ..... 404/56
2,654,297 A * 10/1953 Nettleton ..... E01C 11/14 404/52
3,559,541 A * 2/1971 Watstein ..... E01C 11/14 404/60
4,733,513 A * 3/1988 Schrader ..... E04B 1/483 404/56
4,942,912 A * 7/1990 Gakhar ..... B23Q 9/0028 144/136.1
5,005,331 A * 4/1991 Shaw ..... E01C 11/14 52/396.02
5,216,862 A * 6/1993 Shaw ..... E01C 11/14 52/396.02
5,458,433 A * 10/1995 Stastny ..... F16B 12/04 403/408.1

(Continued)

FOREIGN PATENT DOCUMENTS

CA 2 712 305 7/2009
DE 10 2007 020 816 10/2008

(Continued)

OTHER PUBLICATIONS

Diamond Dowel® System Tapered Plate Dowels for Formed Construction Joints brochure, by PNA Construction Technologies, available Jan. 2010 (2 pages).

(Continued)

*Primary Examiner* — James M Ference
(74) *Attorney, Agent, or Firm* — Neal, Gerber & Eisenberg LLP

(57) ABSTRACT

Various embodiments of the present disclosure provide a load transfer plate and a load transfer plate pocket that co-act to transfer vertical or substantially vertical loads from one concrete slab to an adjacent concrete slab in an enhanced manner by minimizing the air gaps in the concrete slab in which the load transfer plate pocket is positioned.

24 Claims, 16 Drawing Sheets

(56) References Cited

U.S. PATENT DOCUMENTS

| | | | | |
|---|---|---|---|---|
| 5,487,249 | A * | 1/1996 | Shaw | E01C 11/14 404/60 |
| 5,730,544 | A * | 3/1998 | Dils | F16B 12/04 403/13 |
| 6,019,546 | A * | 2/2000 | Ruiz | E01C 11/14 404/134 |
| 6,145,262 | A * | 11/2000 | Schrader | E01C 11/14 404/52 |
| 6,354,760 | B1 * | 3/2002 | Boxall | E01C 11/14 404/47 |
| 6,775,952 | B2 * | 8/2004 | Boxall | E01C 11/08 404/48 |
| 6,926,463 | B2 | 8/2005 | Shaw et al. | |
| 7,004,443 | B2 * | 2/2006 | Bennett | E01C 11/14 249/177 |
| 7,051,988 | B2 | 5/2006 | Shaw et al. | |
| 7,228,666 | B2 * | 6/2007 | Michiels | E01C 11/14 404/55 |
| 7,338,230 | B2 | 3/2008 | Shaw et al. | |
| 7,461,492 | B1 * | 12/2008 | Francies, III | E04B 1/483 52/125.4 |
| 7,481,031 | B2 * | 1/2009 | Boxall | E01C 11/14 404/57 |
| 7,604,432 | B2 | 10/2009 | Shaw et al. | |
| 7,637,689 | B2 * | 12/2009 | Boxall | E01C 11/14 404/47 |
| 7,716,890 | B2 | 5/2010 | Boxall et al. | |
| 7,736,088 | B2 * | 6/2010 | Boxall | E01C 11/14 404/60 |
| 7,748,928 | B2 * | 7/2010 | Estes | E01C 11/14 404/58 |
| 7,828,263 | B2 | 11/2010 | Bennett et al. | |
| 8,302,359 | B2 * | 11/2012 | Boxall | E01C 11/14 52/396.02 |
| 8,303,210 | B2 * | 11/2012 | Parkes | E01C 11/14 404/74 |
| 8,356,955 | B2 * | 1/2013 | Nadler | B28D 1/02 404/73 |
| 8,381,470 | B2 * | 2/2013 | Boxall | E01C 11/14 52/396.02 |
| 8,465,222 | B1 * | 6/2013 | Ghauch | E01C 11/14 404/51 |
| 8,573,884 | B2 | 11/2013 | Nadler | |
| 8,627,626 | B2 * | 1/2014 | Boxall | E04B 1/483 52/396.02 |
| 8,672,579 | B2 * | 3/2014 | Laiho | E01C 11/14 404/47 |
| 9,340,969 | B1 * | 5/2016 | Shaw | E01C 11/06 |
| 9,574,309 | B2 | 2/2017 | McDonald | |
| D813,277 | S | 3/2018 | Terabe et al. | |
| 10,119,281 | B2 * | 11/2018 | Connell | E04B 5/36 |
| D905,626 | S | 12/2020 | Delgado-Nanez | |
| 2005/0036835 | A1 * | 2/2005 | Shaw | E01C 19/504 404/51 |
| 2006/0140721 | A1 * | 6/2006 | Shaw | E01C 19/504 404/60 |
| 2006/0182496 | A1 * | 8/2006 | Shaw | E01C 11/14 404/56 |
| 2006/0275078 | A1 * | 12/2006 | Shaw | E01C 19/504 404/56 |
| 2007/0231068 | A1 * | 10/2007 | Francies | E01C 11/14 404/56 |
| 2007/0269266 | A1 * | 11/2007 | Kelly | E01C 11/14 404/56 |
| 2010/0054858 | A1 * | 3/2010 | Mayo | E01C 11/14 404/56 |
| 2015/0204026 | A1 * | 7/2015 | McDonald | E04B 1/48 404/60 |
| 2017/0096815 | A1 * | 4/2017 | Parkes | E04F 15/14 |
| 2018/0135297 | A1 * | 5/2018 | Parkes | E04B 1/4114 |
| 2018/0171629 | A1 * | 6/2018 | Parkes | E04B 1/043 |
| 2018/0202145 | A1 * | 7/2018 | Hansort | E04B 5/023 |
| 2020/0223095 | A1 | 7/2020 | Miller et al. | |

FOREIGN PATENT DOCUMENTS

| | | |
|---|---|---|
| FR | 3 043 105 | 5/2017 |
| GB | 2 285 641 | 7/1995 |
| WO | WO 2004/065694 | 8/2004 |
| WO | WO 2005/111332 | 11/2005 |
| WO | WO 2006/123176 | 11/2006 |
| WO | WO 2009/153604 | 12/2009 |
| WO | WO 2010/004294 | 1/2010 |
| WO | WO 2013/128151 | 9/2013 |
| WO | 2019074632 | 4/2019 |
| WO | WO 2019/074628 | 4/2019 |

OTHER PUBLICATIONS

Diamond™ Dowel Load Transfer System Industrial Slab on Ground brochure, by Danley™ Systems, available Sep. 2016 (8 pages).

Load Transfer Systems Dowel Cradles Industrial Slab on Ground brochure, by ITW Construction Systems and Danley Systems, available prior to Nov. 16, 2016 (12 pages).

International Search Report and Written Opinion for International Application No. PCT/US2020/063306, dated Mar. 25, 2021 (15 pages).

* cited by examiner

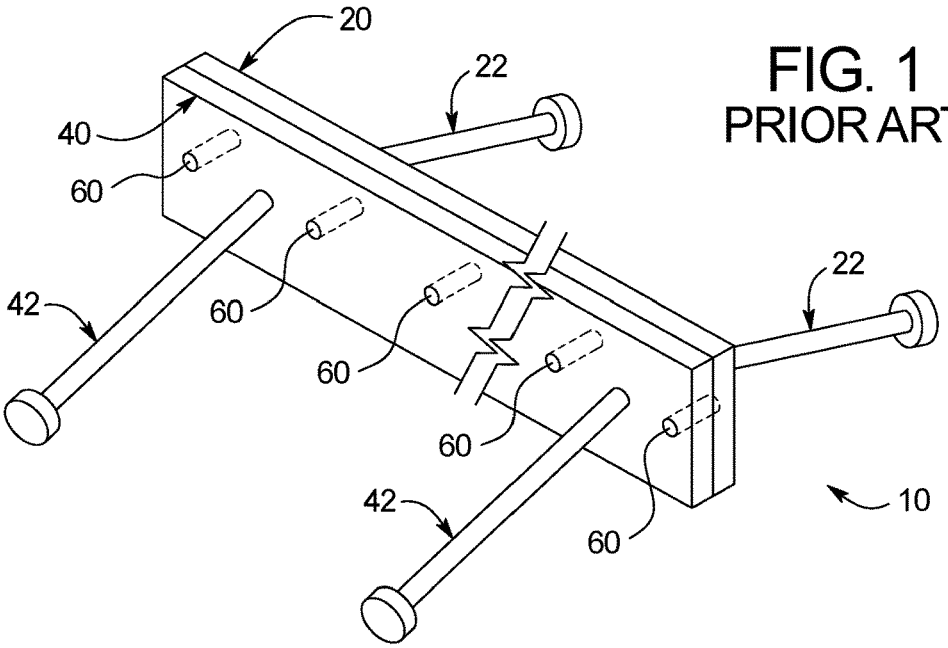
FIG. 1
PRIOR ART
FIG. 2
PRIOR ART
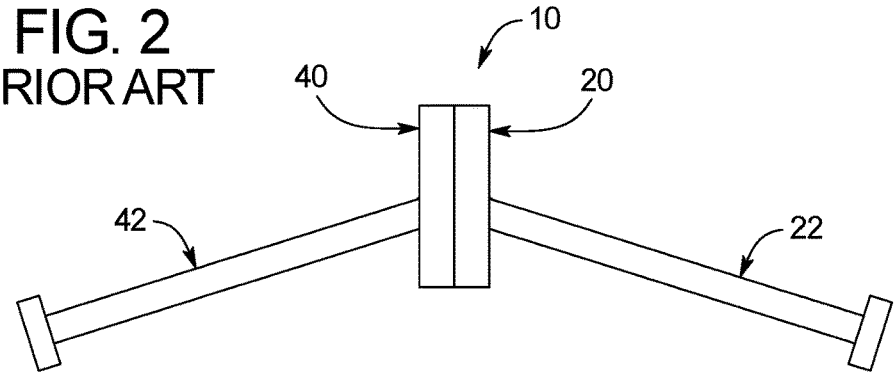
FIG. 3
PRIOR ART
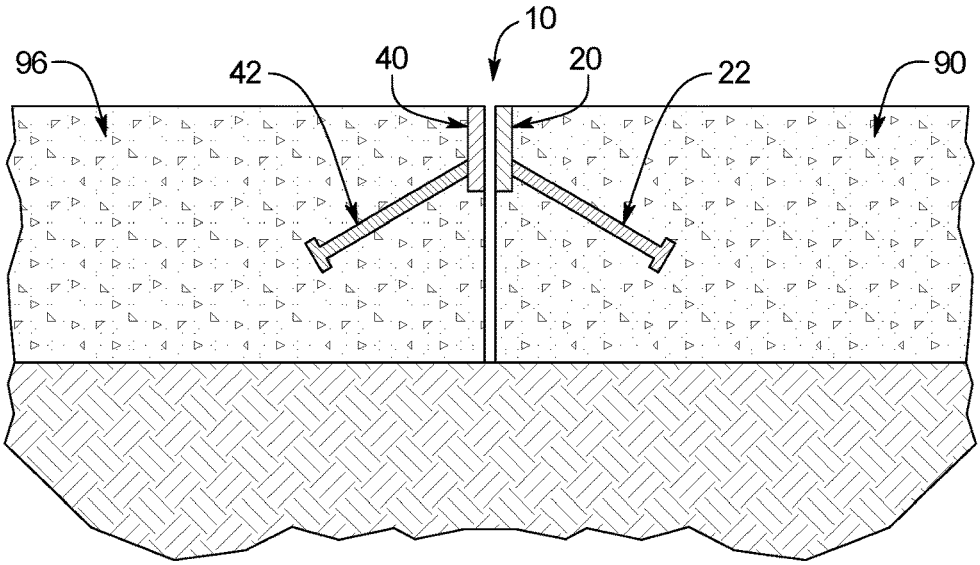

LOAD TRANSFER PLATE APPARATUS

CROSS-REFERENCE TO RELATED APPLICATION

This application is related to the following commonly owned co-pending patent applications: U.S. application Ser. No. 29/718,065, entitled "LOAD TRANSFER PLATE POCKET," and U.S. application Ser. No. 29/718,069, entitled "LOAD TRANSFER PLATE POCKET INTERNAL BRACING INSERT".

BACKGROUND

For various logistical and technical reasons, concrete floors often include a series of individual cast-in-place concrete blocks or slabs referred to herein as "concrete slabs" or "slabs". These concrete slabs provide several advantages including relief of internal stress due to curing, shrinkage, and thermal movement. There are various known issues with such concrete slabs. These issues often involve the joint between concrete slabs, the interface where one concrete slab meets another concrete slab, and the relative vertical movement of adjacent concrete slabs.

More specifically, freshly poured concrete shrinks considerably as it cures or hardens due to the chemical reaction that occurs between the cement and water. As the concrete shrinks, tensile stress accumulates in the concrete. Therefore, the joints need to be free to open and thus enable shrinkage of each of the individual concrete slabs without damaging the concrete floor. The joint openings create discontinuities in the concrete floor surface that can cause the wheels of a vehicle (such as a forklift truck) to impact the edges of the adjacent concrete slabs that form the joint and chip small pieces of concrete from the edge of each concrete slab, particularly if the joint edges are not vertically aligned. This damage to the edges of concrete slabs is commonly referred to as joint spalling. Joint spalling can interrupt the normal working operations of a facility by slowing down forklift and other truck traffic, and/or causing damage to trucks and the carried products. Severe joint spalling and uneven joints can cause loaded forklift trucks to overturn (which of course is dangerous to people in those facilities). Joint spalling can also be very expensive and time consuming to repair.

Joint edge assemblies that protect such joints between concrete slabs are widely used in the construction of concrete floors (such as concrete floors in warehouses). Examples of known joint edge assemblies are described in U.S. Pat. Nos. 6,775,952 and 8,302,359. Various known joint edge assemblies enable the joint edges to both self-open with respect to the opposite joint edge as the adjacent concrete slabs shrink during curing or hardening. One known joint edge assembly is generally illustrated in FIGS. 1, 2, 3, and 4. This known joint edge assembly 10 includes two separate elongated joint edge members 20 and 40 temporarily held together by a plurality of connectors 60. The connectors 60 connect the elongated joint edge members 20 and 40 along their lengths during installation. This known joint edge assembly 10 further includes a plurality of anchors 22 that extend from the elongated joint edge member 20 into the region where the concrete of the first concrete slab 90 is to be poured such that, upon hardening of the first concrete slab 90, the anchors 22 are cast within the body of the first concrete slab 90. This known joint edge assembly 10 further includes a plurality of anchors 42 that extend from the elongated joint edge member 40 into the region where the concrete of the second concrete slab 96 is to be poured such that, upon hardening of the second concrete slab 96, the anchors 42 are cast within the body of the concrete slab 96. This known joint edge assembly is positioned such that the ends or edges of the concrete slabs are aligned with the respective outer surfaces of the elongated joint edge members. FIGS. 1 and 2 illustrate the joint edge assembly 10 prior to installation and before the concrete is poured, and FIG. 3 illustrates the joint edge assembly 10 after installation and after the concrete slabs have started shrinking such that the elongated joint edge members 20 and 40 have separated to a certain extent.

Another issue with such joints involves the vertical movements of adjacent concrete slabs relative to each other. The concrete slabs (such as concrete slabs 90 and 96) are preferably configured to move individually, and are also preferably configured with load transferring devices to transfer loads from one concrete slab to the adjacent concrete slab. Transferring loads between adjacent concrete slabs has been accomplished using various different load transferring devices. For example, certain known load transferring devices are in the form of steel dowels and dowel receiving sheaths having circular cross-sections (such as those disclosed in U.S. Pat. Nos. 5,005,331, 5,216,862, and 5,487,249). Other known load transferring devices are in the form of steel dowels and dowel receiving sheaths having rectangular cross-sections (such as those disclosed in U.S. Pat. No. 4,733,513). Such circular and rectangular dowels are capable of transferring loads between adjacent concrete slabs, but have various shortcomings. For example, if such circular or rectangular dowels are misaligned (i.e., not positioned perpendicular to joint), they can undesirably lock the joint together causing unwanted stresses that could lead to slab failure in the form of cracking of the concrete slab. Such misaligned dowels can also restrict movement of the concrete slabs in certain directions. Another shortcoming of such circular and rectangular dowels is that they typically enable the adjacent slabs to move only along the longitudinal axis of the dowel. Another known shortcoming of such circular and rectangular dowels results from the fact that, under a load, only the first 3 to 4 inches of each dowel is typically used for transferring the load from one slab to the adjacent slab. This can create relatively high loadings per square inch at the edge of one or more of the adjacent concrete slabs, which can result in failure of the concrete above or below the dowel.

To solve these problems, load transferring devices such as the dowel and dowel receiving sheath disclosed in U.S. Pat. No. 6,354,760 were developed. These known load transferring devices provide increased relative movement between the adjacent concrete slabs in a direction parallel to the longitudinal axis of the joint and reduce loadings per square inch in the adjacent concrete slabs close to the joint, while transferring loads between the adjacent concrete slabs. These load transferring devices are commercially sold by the assignee of this disclosure. These load transferring devices have been widely sold and commercially utilized.

In certain circumstances, it has been found that these dowel receiving sheaths can cause air pockets to be formed in the concrete slabs in which they are positioned, such as beneath the sheaths in the concrete slabs.

Accordingly, there is a need for improved load transfer receiving devices that solve this problem.

SUMMARY

Various embodiments of the present disclosure provide a load transfer plate apparatus that includes a load transfer plate pocket that solves the above problem.

Various embodiments of the present disclosure provide a load transfer plate pocket that minimizes air pockets in the concrete slabs and that minimizes fractures to the concrete slabs above or below the load transfer plate pocket.

Various other embodiments of the present disclosure provide a load transfer apparatus including a load transfer plate and a load transfer plate pocket that co-act to transfer vertical or substantially vertical loads from one concrete slab to the adjacent concrete slab in an enhanced manner, that minimizes air pockets in the concrete slabs, and that minimizes fractures to the concrete slabs above or below the load transfer plate pocket.

Various other embodiments of the present disclosure provide a load transfer apparatus including a load transfer plate, a load transfer plate bracing insert, and a load transfer plate pocket that co-act to transfer vertical or substantially vertical loads from one concrete slab to the adjacent concrete slab in an enhanced manner, that minimizes air pockets in the concrete slabs, and that minimizes fractures to the concrete slabs above or below the load transfer plate pocket.

Additional features and advantages of the present invention are described in, and will be apparent from, the following Detailed Description and the Figures.

BRIEF DESCRIPTION OF THE FIGURES

FIG. 1 is a perspective view of a known joint edge assembly.

FIG. 2 is an end view of the known joint edge assembly of FIG. 1.

FIG. 3 is a cross-sectional view of the known joint edge assembly of FIG. 1 shown mounted in two adjacent concrete slabs (shown in fragmentary) on a substrate (shown in fragmentary), and generally illustrating the separation of the two adjacent concrete slabs after they have shrunk to a certain extent.

DETAILED DESCRIPTION OF EXAMPLE EMBODIMENTS

Various embodiments of the present disclosure provide an improved load transfer apparatus including a load transfer plate, a load transfer plate pocket, and a load transfer plate bracing insert that solve the above problems. More specifically, various embodiments of the load transfer plate and a load transfer plate pocket that co-act to transfer vertical or substantially vertical loads from one concrete slab to the adjacent concrete slab, to cause air bubbles to be propelled towards the edges of pocket to minimize air pockets in the concrete slabs above and below the load transfer plate pocket, which in turn maximizes the concrete flow, uniformity and compactness of the concrete below an above the load transfer plate pocket, and thus minimize fractures to the concrete slabs above or below the load transfer plate pocket. It should also be appreciated that the load transfer plate pocket additionally inhibits movement of the pocket during the pouring of the concrete slab due to air pockets or due to improper attachment to the form.

Figure 17:
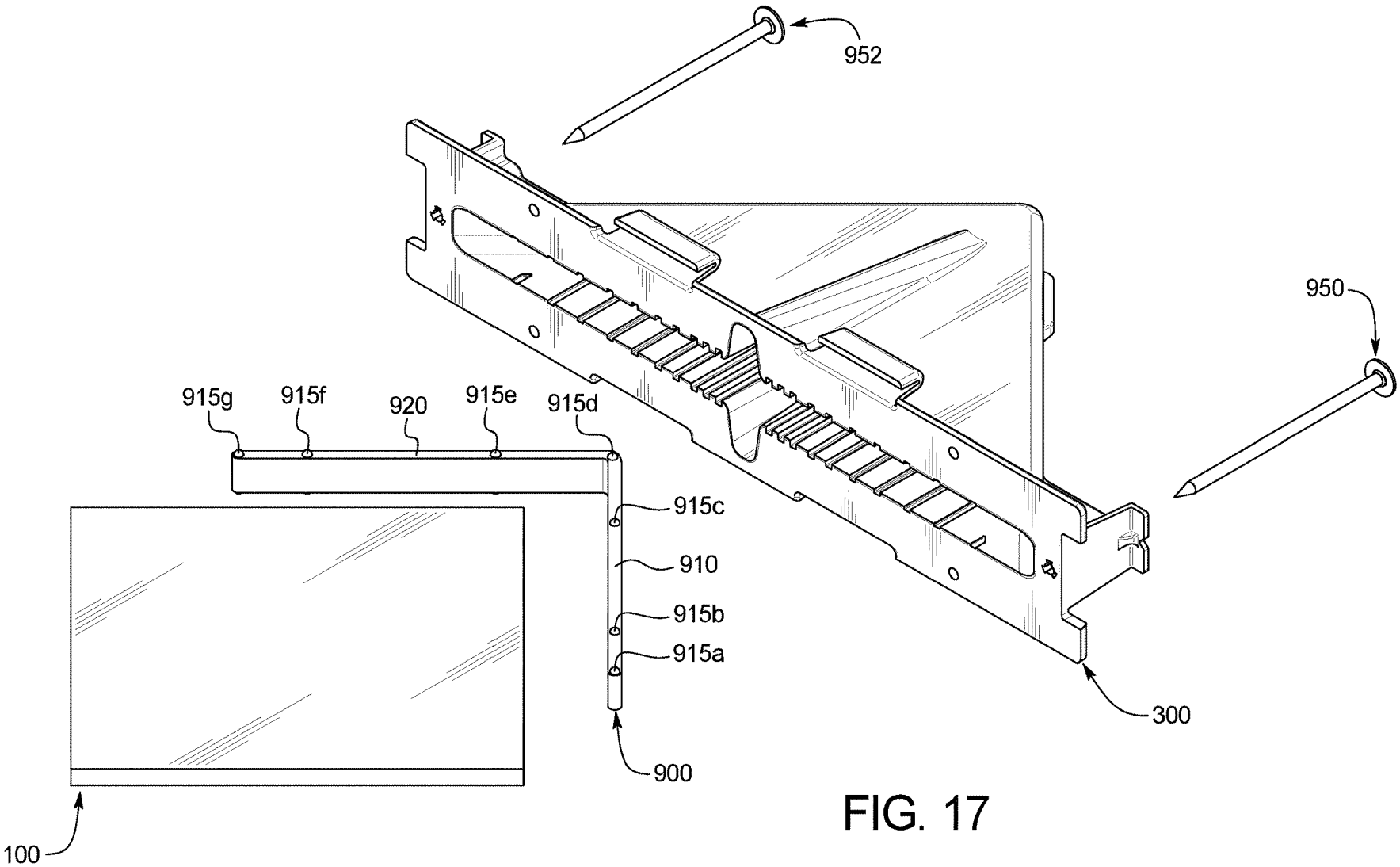
FIG. 17 is an exploded front rear perspective side view of the load transfer plate pocket of FIG. 6, a load transfer plate bracing insert of the present disclosure, the load transfer plate of FIG. 5, and two fasteners prior to attachment of the load transfer place pocket to a form (not shown) by the two fasteners and prior to positioning of the load transfer plate bracing insert and the load transfer plate in the load transfer plate pocket.
Figure 18:
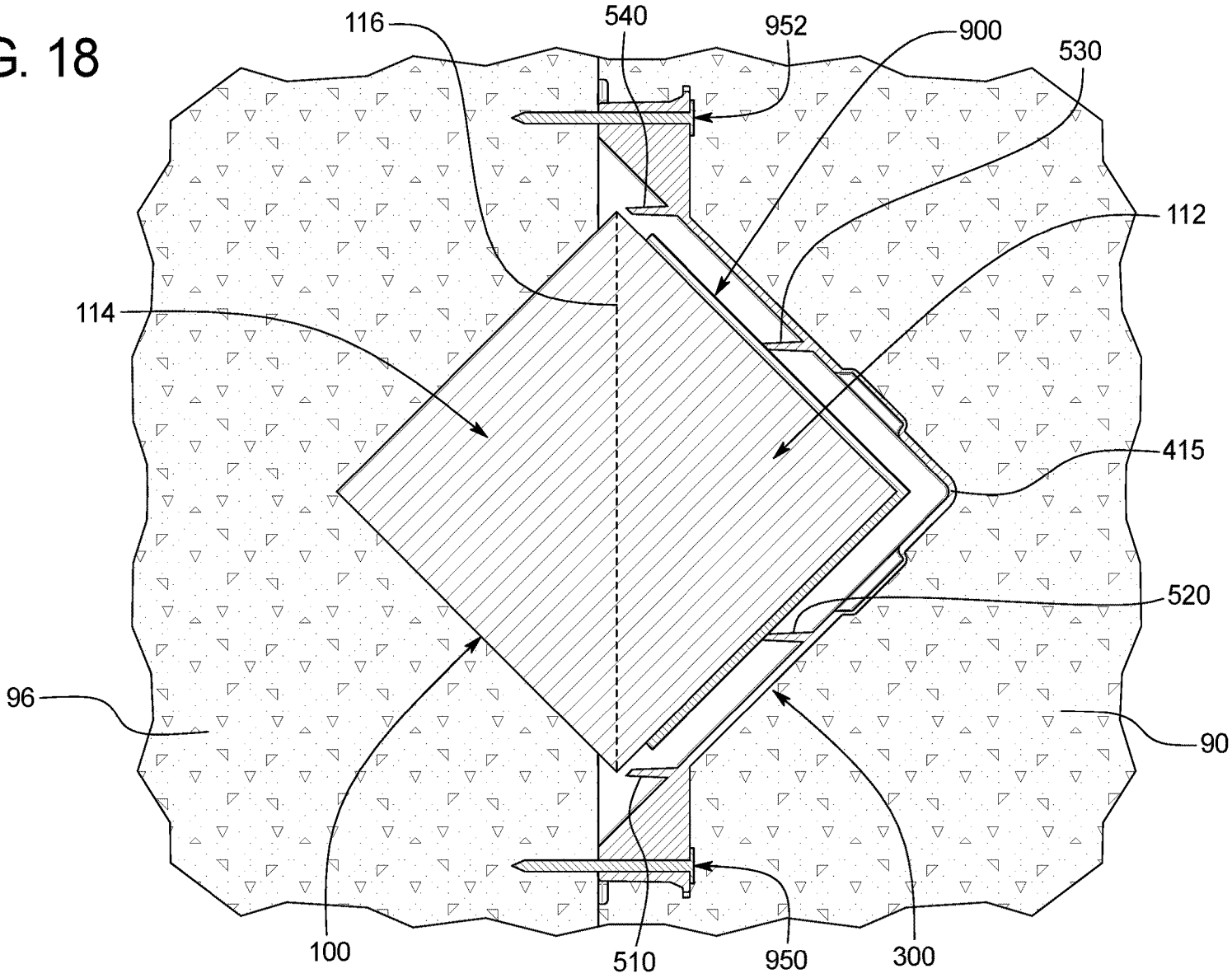
FIG. 18 is cross-sectional view of the load transfer plate pocket of FIG. 6, the load transfer plate bracing insert of FIG. 17, the load transfer plate of FIG. 5, and two fasteners shown mounted in two adjacent concrete slabs (shown in fragmentary).

Referring now to FIGS. 5, 6, 7, 8, 9, 10, 11, 12, 13, 14, 15, 16, 17, and 18, one example embodiment of the load transfer plate of the present disclosure is generally indicated by numeral 100, one example embodiment of the load transfer plate pocket of the present disclosure is generally indicated by numeral 300, one example of the load transfer plate bracing insert is generally indicated by numeral 900, and two example fasteners are generally indicated by numerals 950 and 952. FIGS. 17 and 18 also generally partially illustrate one method of employing or installing the load transfer plate pocket 300, the load transfer plate 100, and the load transfer plate bracing insert 900 of the present disclosure in a first cast-in-place slab (such as a first concrete slab 90) and a second cast-in-place slab (such as a second concrete slab 96). It should be appreciated that multiple spaced apart sets of load transfer plate pockets 300, load transfer plates 100, and load transfer plate bracing inserts 900 of the present disclosure will be employed in such adjacent concrete slabs to co-act to transfer vertical or substantially vertical loads from one concrete slab to the adjacent concrete slab in an enhanced manner by optimizing the positions of the load transfer plates 100 relative to the adjacent concrete slabs for load transfer between the adjacent concrete slabs, by minimizing air pockets in the concrete slabs above and below the load transfer plate pockets, and thus minimize fractures to the concrete slabs above or below the load transfer plate pockets.

In this illustrated example embodiment, the load transfer plate pocket 300 is configured to be attached to a conventional form (not shown) before the first concrete slab 90 is poured such that the load transfer plate pocket 300 extends into the first concrete slab 90 and is maintained in the first concrete slab 90 after the first concrete slab 90 is poured and hardened or cured as shown in FIG. 18. The load transfer plate bracing insert 900 and the load transfer plate 100 is configured to be inserted in the load transfer plate pocket 300 after (or alternatively before) the first concrete slab 90 is poured, and before the second concrete slab 96 is poured.

It should be appreciated that in an alternative method of the present disclosure, if slab 96 is poured before slab 90, then the load transfer plate pocket 300 would be attached to a form before the concrete slab 96 is poured such that the load transfer plate pocket 300 extends into the concrete slab 96 and would be maintained in the concrete slab 96 after the concrete slab 96 is poured and hardened or cured. If concrete slab 96 is poured before concrete slab 90, the load transfer plate bracing insert 900 and the load transfer plate 100 would be inserted in the load transfer plate pocket 300 after (or alternatively before) the concrete slab 96 is poured, and before the concrete slab 90 is poured. It should be appreciated that the present disclosure contemplates use of the load transfer plate pocket 300 and load transfer plate 100 without the use of the load transfer plate bracing insert 900.

Figure 4:
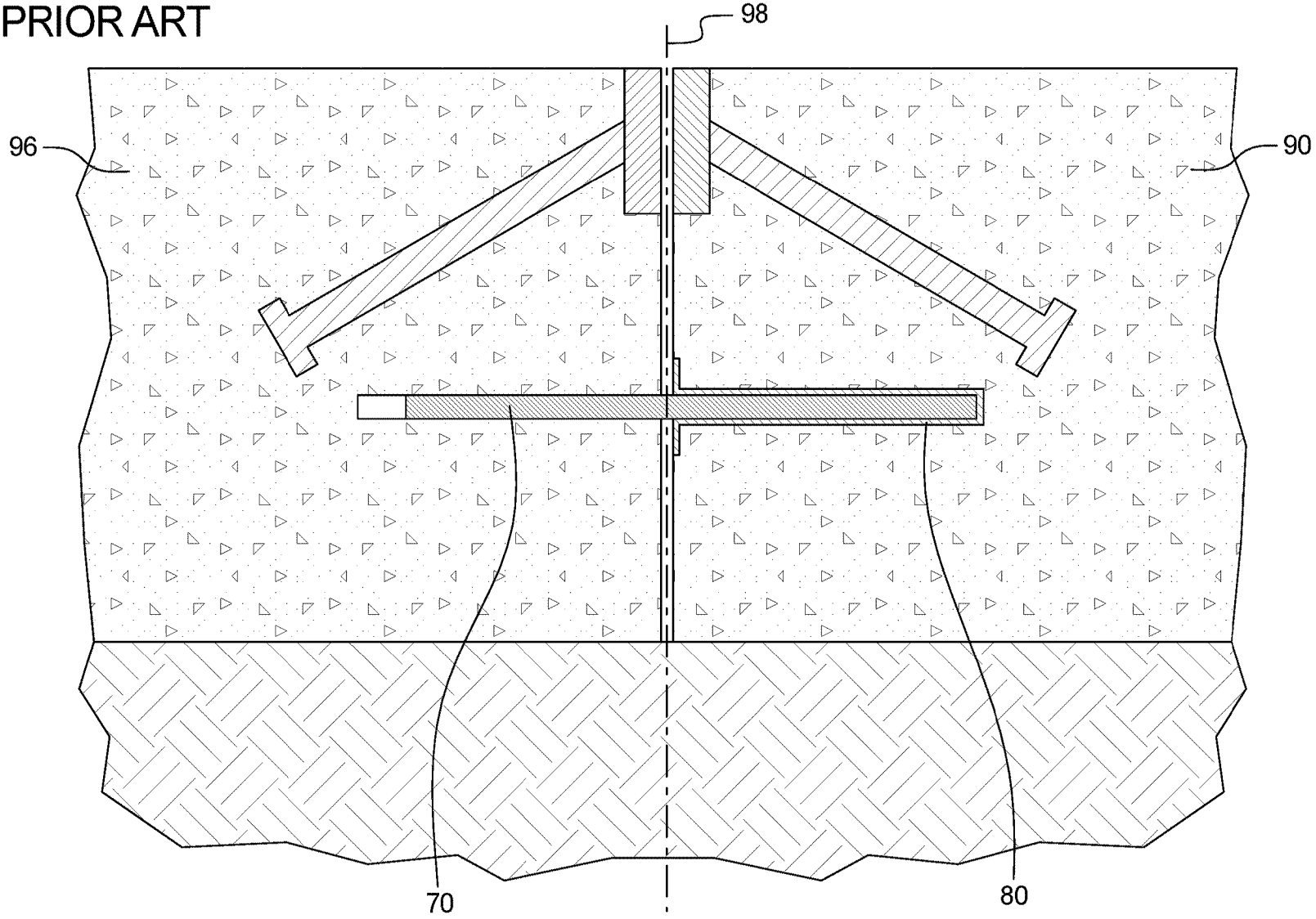
FIG. 4 PRIOR ART
FIG. 4 is a cross-sectional view of the known joint edge assembly of FIG. 1 shown mounted in two adjacent concrete slabs (shown in fragmentary) on a substrate (shown in fragmentary), a known dowel pocket mounted in one of the concrete slabs, and a known load transfer plate mounted in the other concrete slab and partially received in the dowel pocket.
Figure 5:
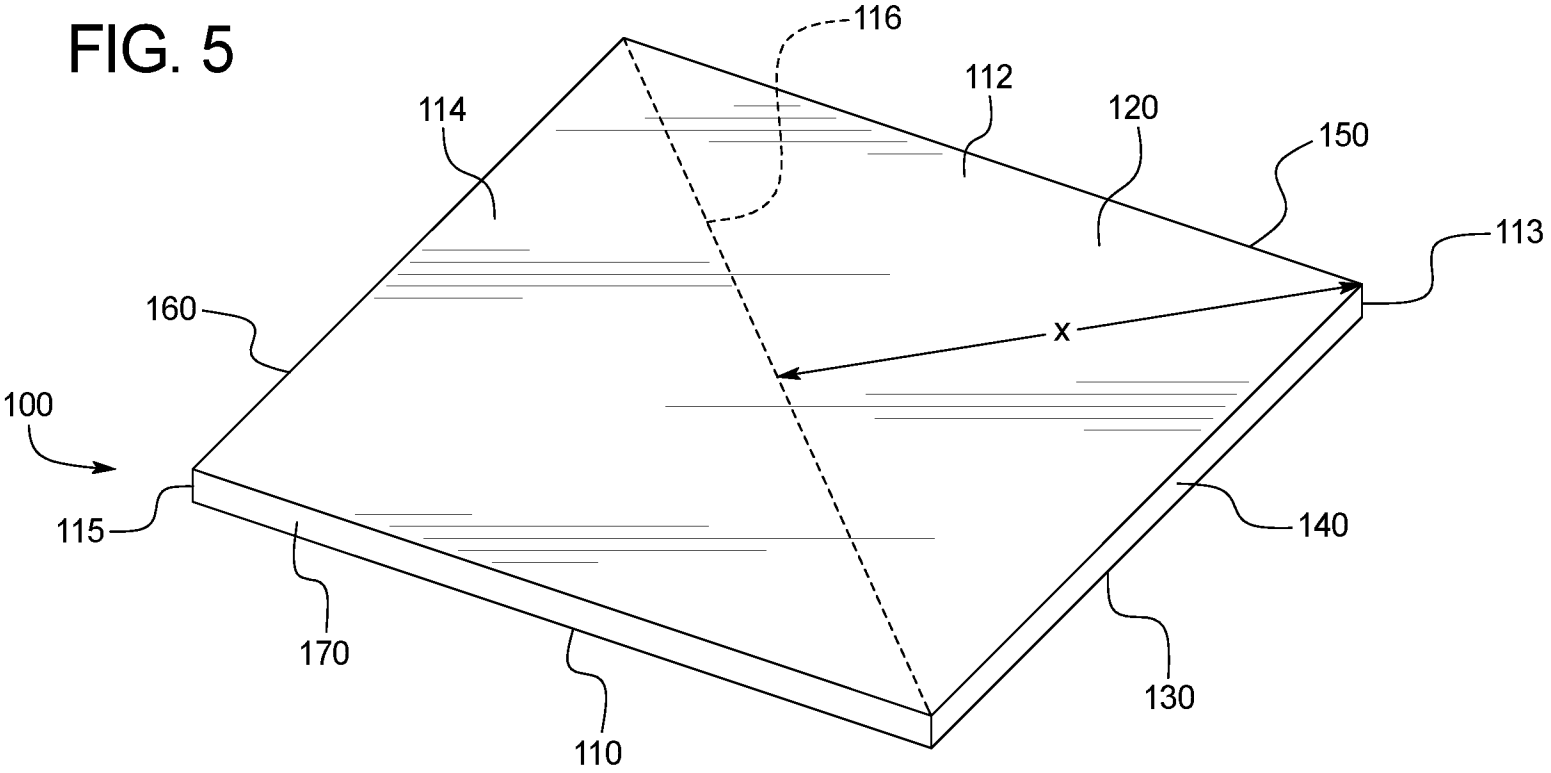
FIG. 5 is a top perspective view of a load transfer plate of one example embodiment of the present disclosure.

In this illustrated example embodiment, as best shown in FIGS. 5 and 18, the load transfer plate 100 includes a generally diamond shaped body 110 having: (a) a substantially tapered first half or portion 112 configured to protrude into and move with respect to the load transfer plate pocket 300 that is secured in the first concrete slab 90; and (b) a substantially tapered second half or portion 114 configured to be initially partially positioned in the load transfer plate pocket 300 at installation and also protrude into and be secured in the second concrete slab 96. In this illustrated embodiment, the substantially tapered first portion 112 and the substantially tapered second portion 114 are substantially equal in size and shape.

In this illustrated example embodiment, the substantially tapered first portion 112 has a largest width (measured parallel to the longitudinal axis of the joint) at the area of the first portion 112 adjacent to tapered second portion 114, and a smallest width at the edge 113. In this illustrated example embodiment, the first portion 112 is uniformly tapered from the area of the first portion 112 adjacent to second portion 114 to the edge 113; however, such taper does not have to be uniform in accordance with the present disclosure.

In this illustrated example embodiment, the substantially tapered second portion 114 has a largest width (measured parallel to the longitudinal axis of the joint) at the area of the second portion 114 adjacent to tapered first portion 112, and a smallest width at the edge 115. In this illustrated example embodiment, the second portion 114 is uniformly tapered from the area of the second portion 114 adjacent to first portion 112 to the edge 115; however, such taper does not have to be uniform in accordance with the present disclosure.

Accordingly, in this illustrated example embodiment, the load transfer plate 100 has its greatest width at the area where the substantially tapered first portion 112 and the substantially tapered second portion 114 meet or connect (i.e., along the center line or plane 116).

In this illustrated example embodiment, the load transfer plate 100 is also relatively wide compared to its thickness or height and has a length to width ratio of approximately 1:1; however, it should be appreciated that the width compared to the thickness or height may vary, and that the length to width ratio may vary in accordance with the present disclosure.

The body 110 of the load transfer plate 100 also generally includes: (a) a substantially planar upper surface 120; (b) a substantially planar lower surface 130; (c) a first outer edge 140; (d) a second outer edge 150; (e) a third outer edge 160; and (f) a fourth outer edge 170.

It should be appreciated that the load transfer plate may be otherwise suitably configured in accordance with the present disclosure.

The load transfer plate 100 is made from a suitable metal (such as steel) in this illustrated embodiment, but can be made from other suitable materials This illustrated example embodiment of the load transfer plate pocket 300 includes: (1) an attachment wall 310; (2) a generally triangular shaped body 400 integrally formed with, connected to, and extending from the back (or back surface 316) of the attachment wall 310; and (3) fastener receivers 700 and 800 respectively integrally formed with and extending from the back (or back surface 316) of the attachment wall 310, and the opposite sides of the body 400. The load transfer plate pocket 300 is symmetrical from top to bottom and from side to side, and thus is configured to be used in either orientation (i.e., right side up or upside down). This facilitates ease of manufacture, ease of use, and reduction of needed inventory. This also facilitates reduction of errors in positioning during installation. The body 400 is configured to minimize air pockets in the concrete slabs above and below the load transfer plate pocket, and thus minimize fractures to the concrete slabs above or below the load transfer plate pocket. This configuration also enables the installation in either orientation whilst maintaining the benefits of the air displacement features and structural enhancements. The load transfer plate pocket 300 is made from a suitable plastic (such as a High Impact Polystyrene (HIPS)) in this illustrated embodiment, but can be made from other suitable materials.

More specifically, in this illustrated example embodiment, the attachment wall 310 includes: (1) a generally flat partially rectangular member 312 having a front surface 314, a back surface 316, a top edge 318, a bottom edge 320, a first side edge 322, and a second side edge 324; and (2) four rearwardly extending securing tabs 350, 360, 370, and 380.

The member 312 defines: (a) a load transfer plate receiving opening 330 (that provides access to a generally triangular chamber 490 defined by the body 400); (b) a first fastener opening 332; and (c) a second fastener opening 334. The load transfer plate receiving opening 330 is configured such that the load transfer plate 100 can freely move through the load transfer plate receiving opening 330 and into and out of the load transfer plate receiving chamber 490 defined by the body 400. The first fastener opening 332 and the second fastener opening 334 are configured to respectively receive fasteners such as nails 950 and 952 as shown in FIGS. 17 and 18 to attach and hold the load transfer plate pocket 300 to a form (not shown) before and during pouring of the first concrete slab 90 such that: (a) the attachment wall 310 extends in the same plane as the outer vertical side surface of the first concrete slab 90; (b) four rearwardly extending securing tabs 350, 360, 370, and 380 each extends into the first concrete slab 90; and (c) the body 400 of the load transfer plate pocket 300 extends into the first concrete slab 90. This example member 312 can include any suitable quantity of additional fastener openings (such as indicated by the drawings but not labeled).

Figure 6:
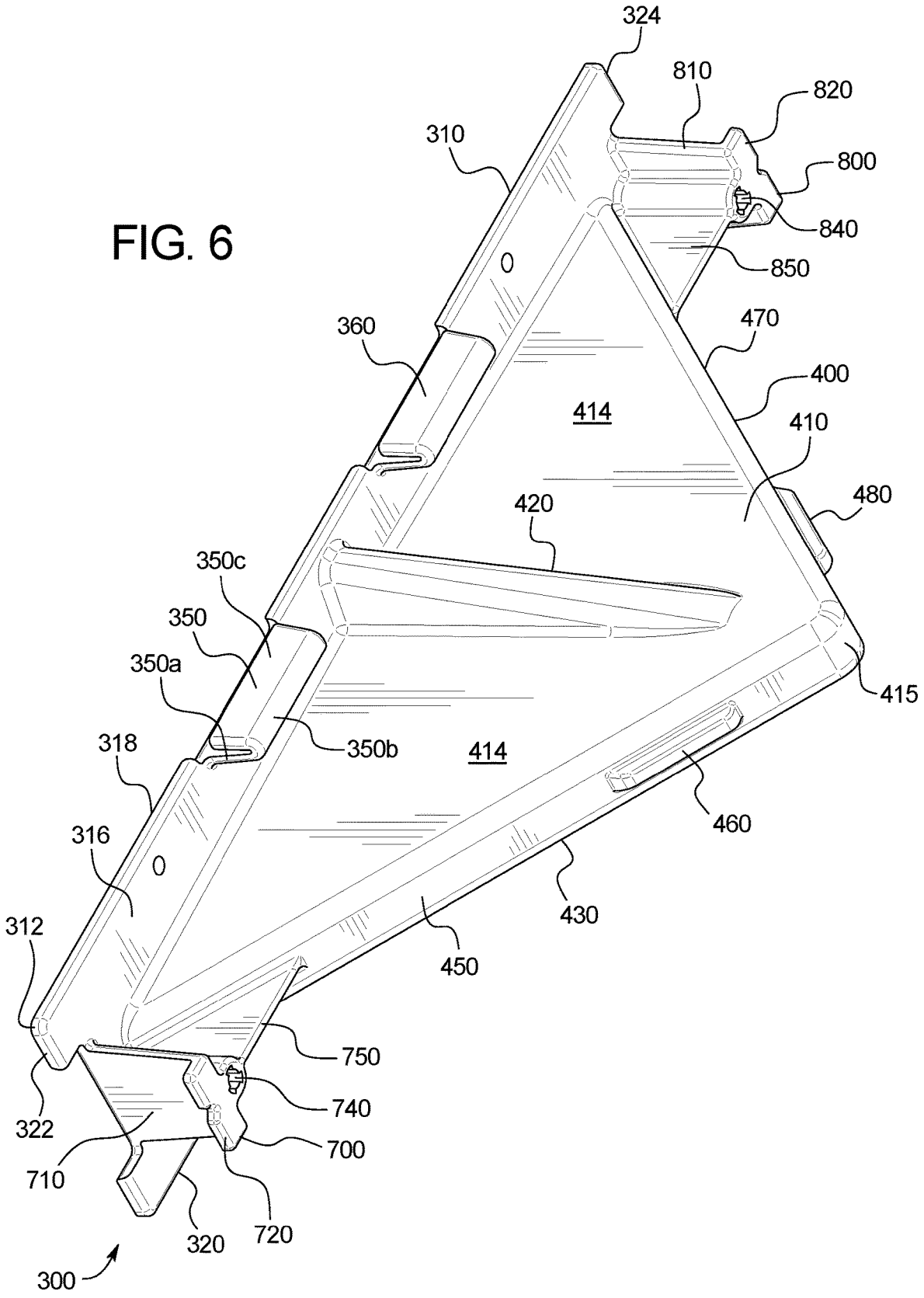
FIG. 6 is a top rear perspective view of a load transfer plate pocket of one example embodiment of the present disclosure.
Figure 7:
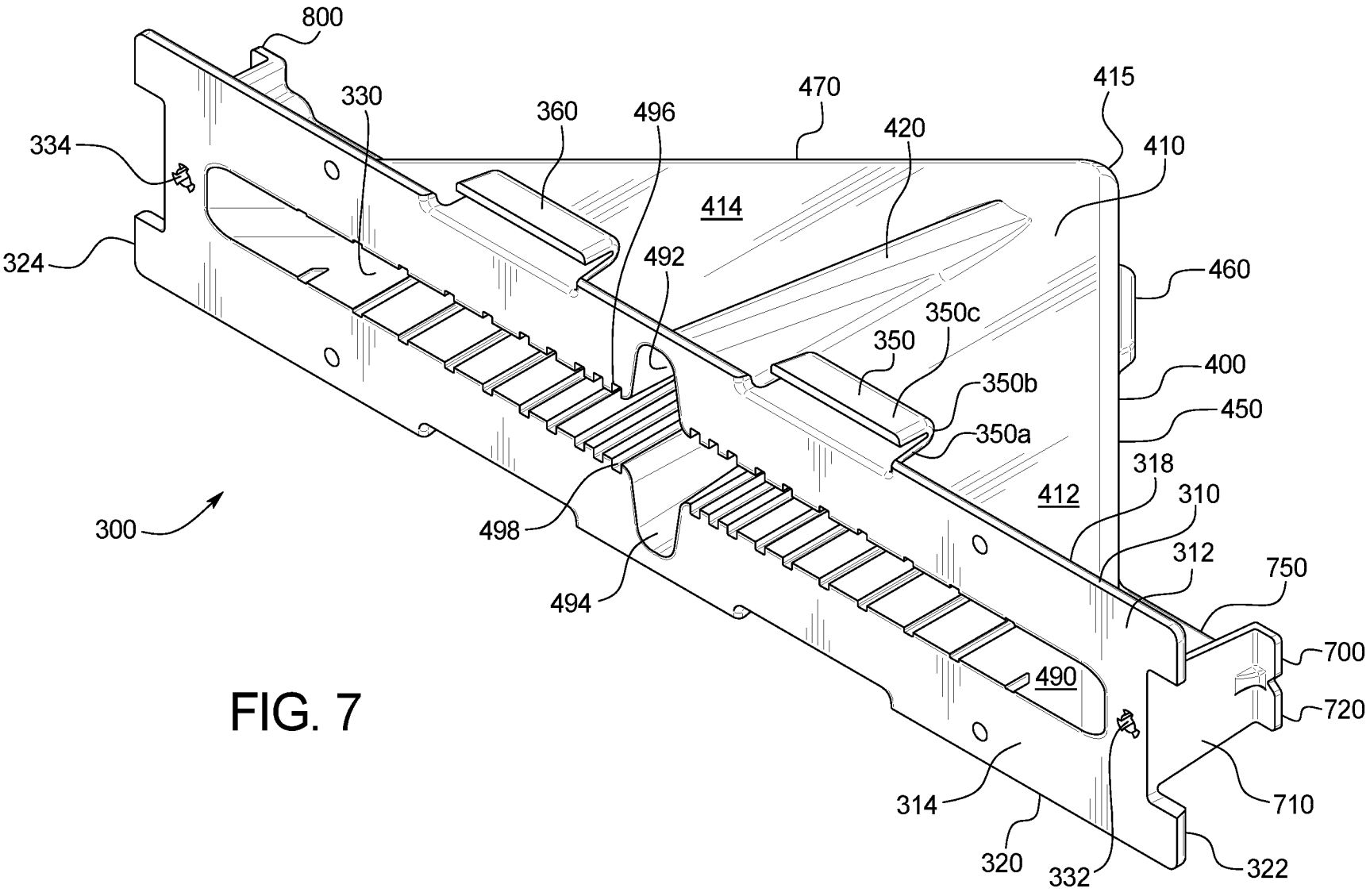
FIG. 7 is a top front perspective view of the load transfer plate pocket of FIG. 6.
Figure 8:
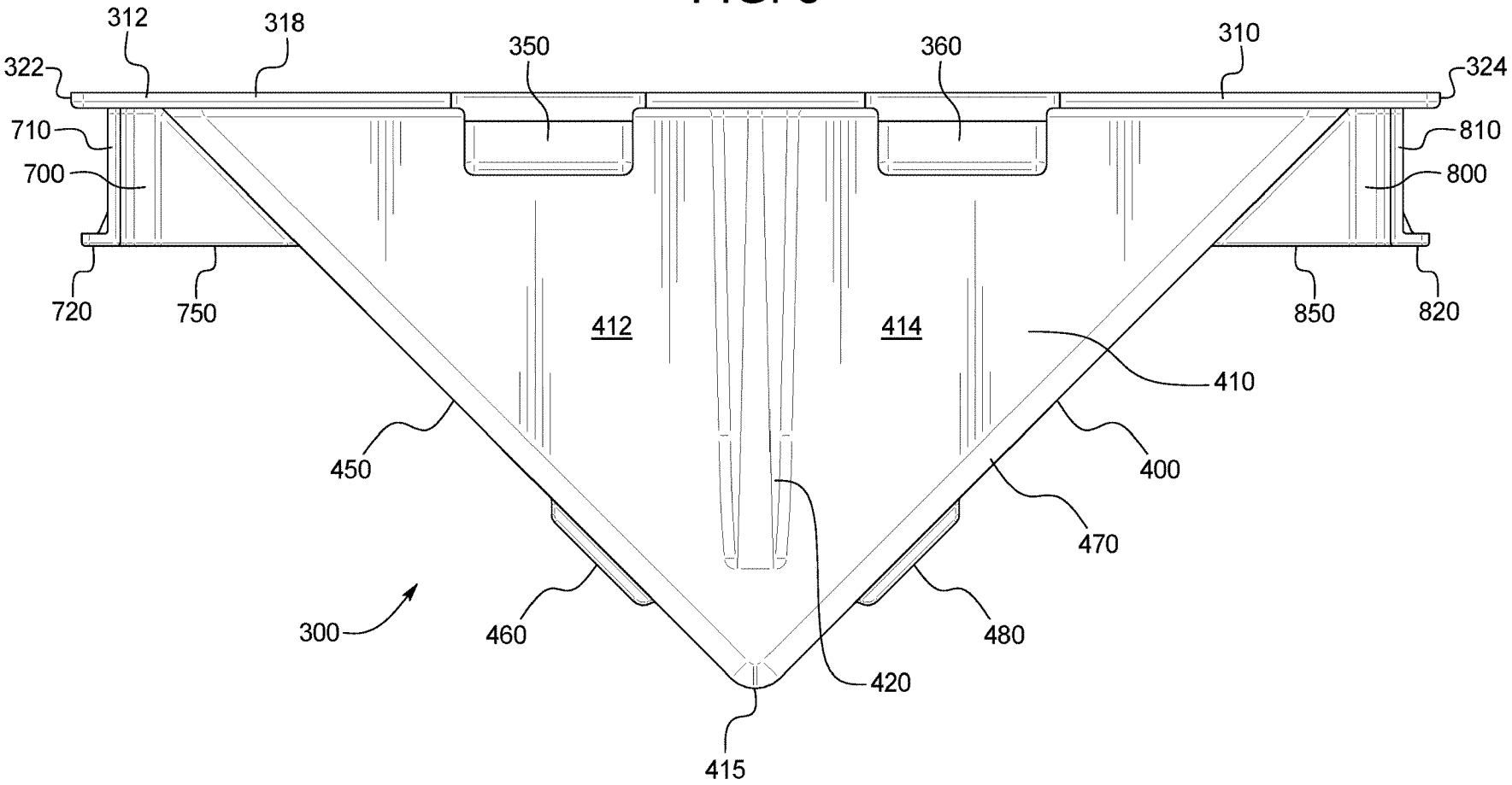
FIG. 8 is a top view of the load transfer plate pocket of FIG. 6.
Figure 9:
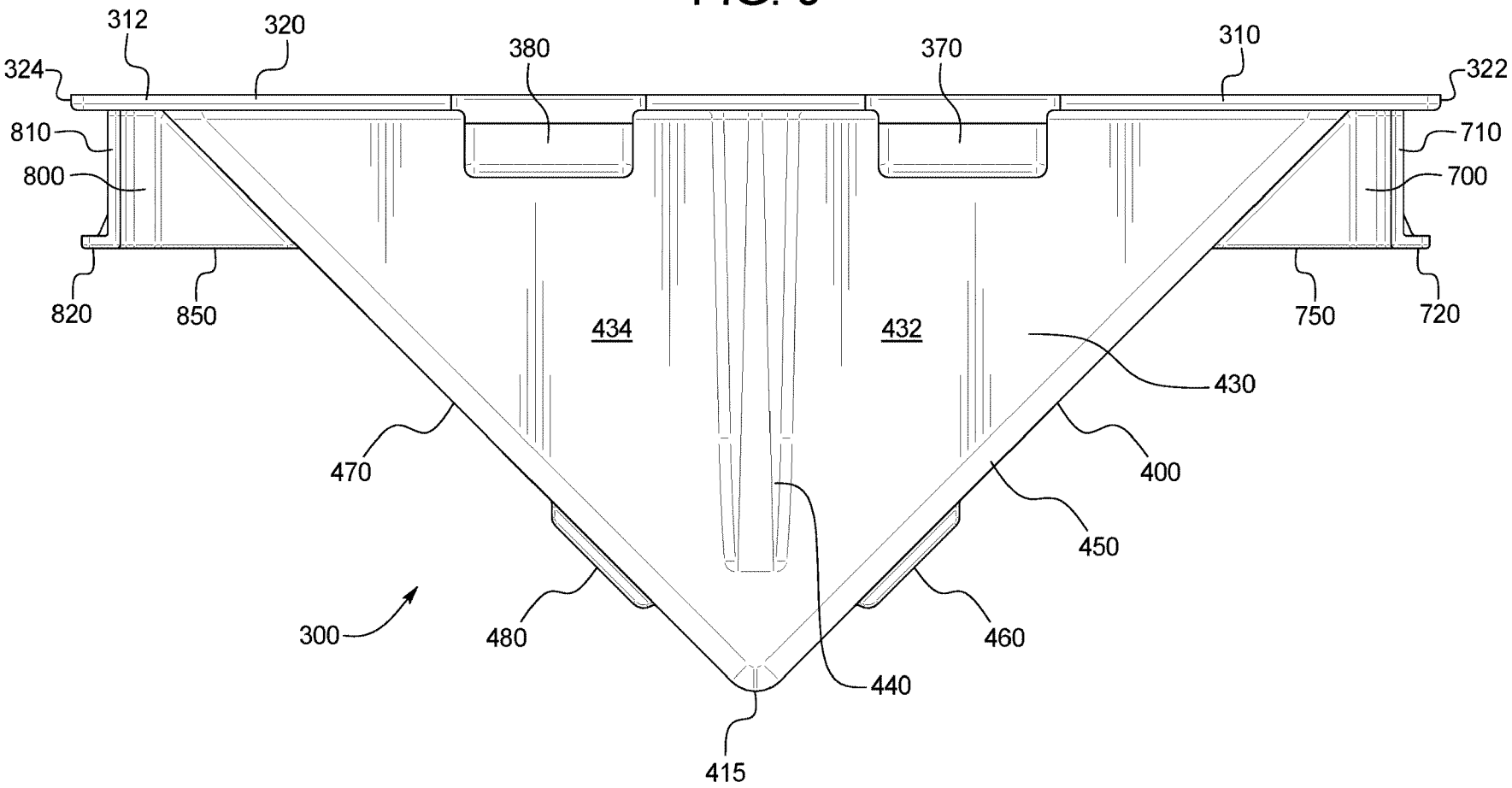
FIG. 9 is a bottom view of the load transfer plate pocket of FIG. 6.
Figure 10:
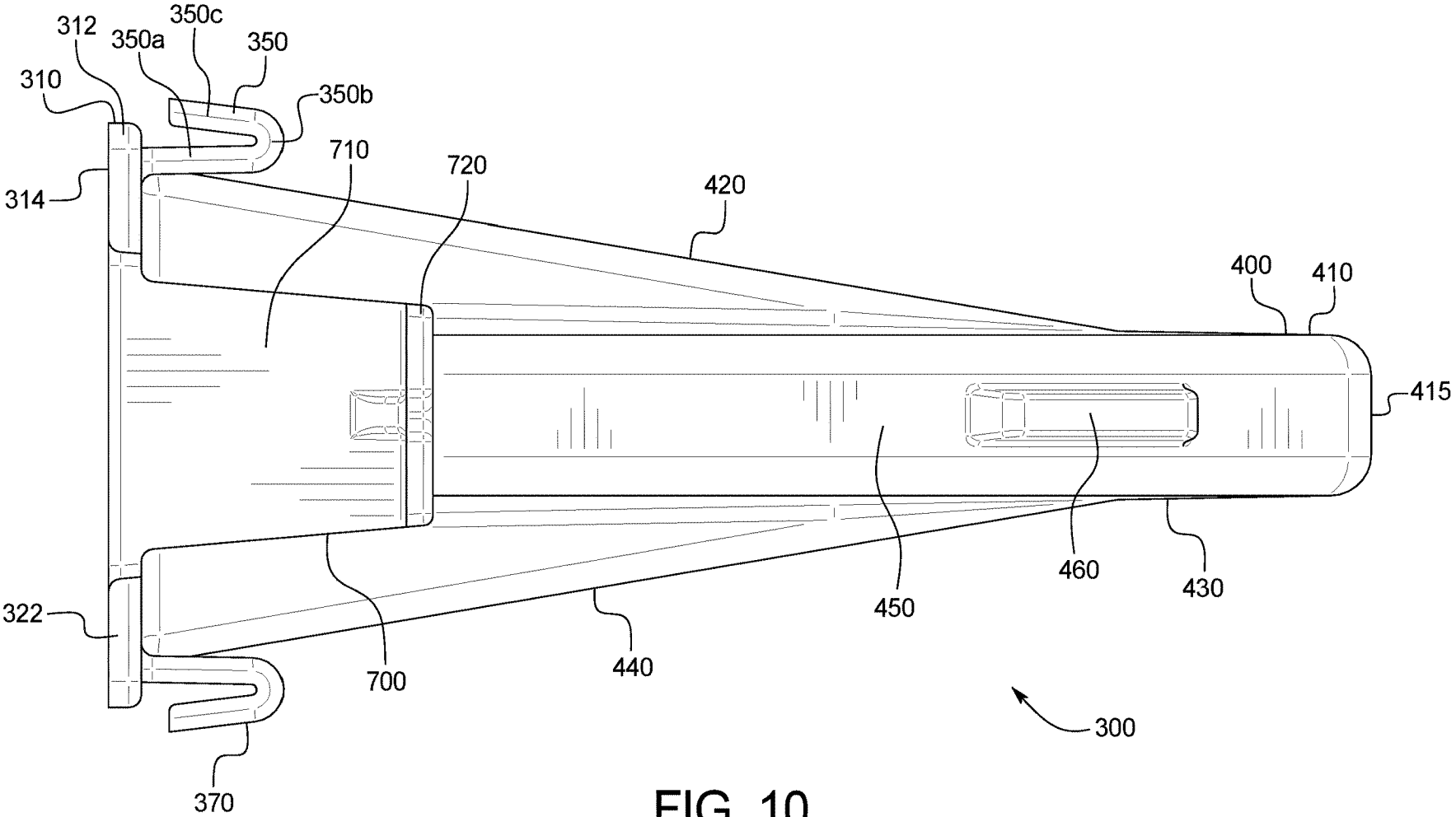
FIG. 10 is a right side view of the load transfer plate pocket of FIG. 6.
Figure 11:
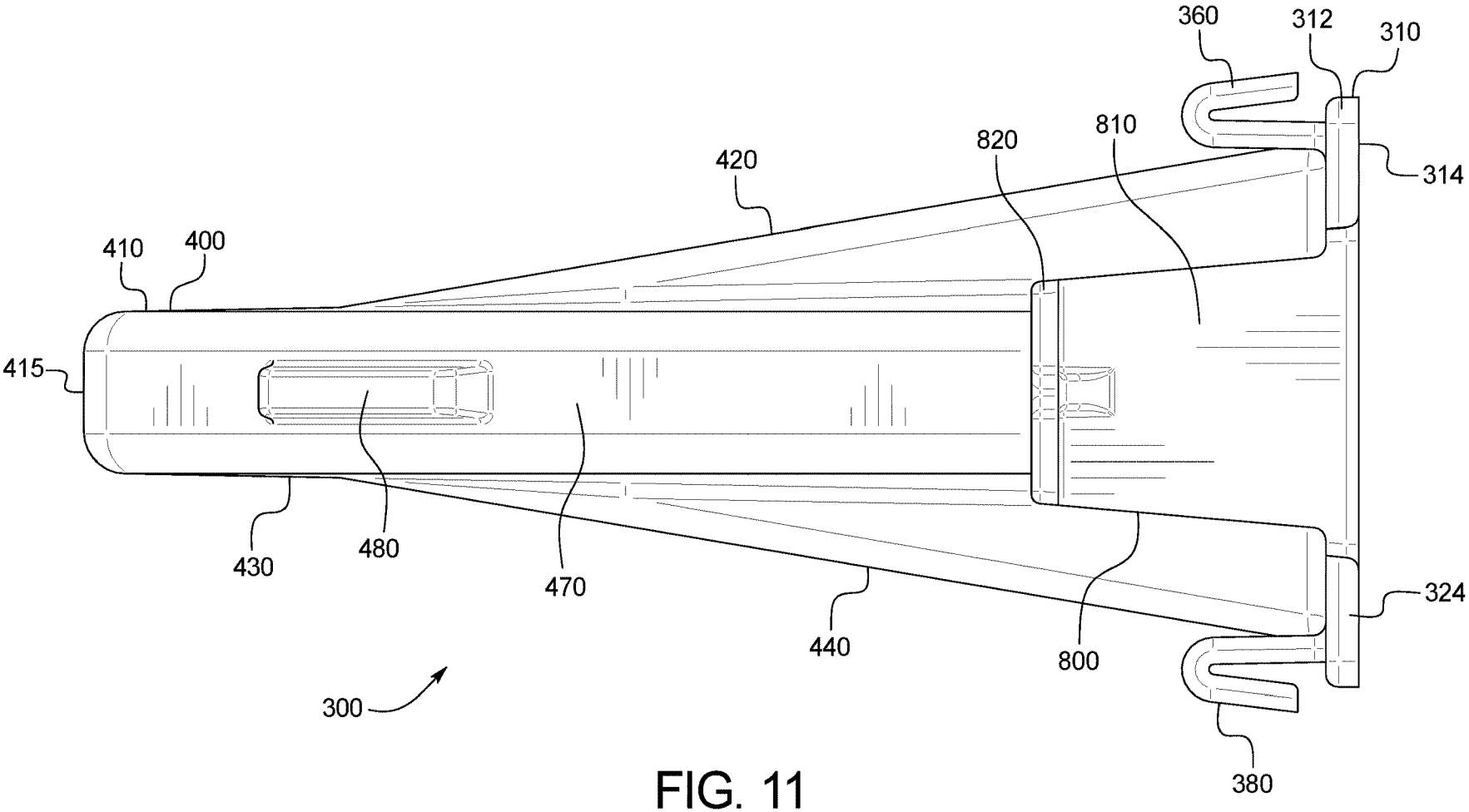
FIG. 11 is a left side view of the load transfer plate pocket of FIG. 6.
Figure 12:
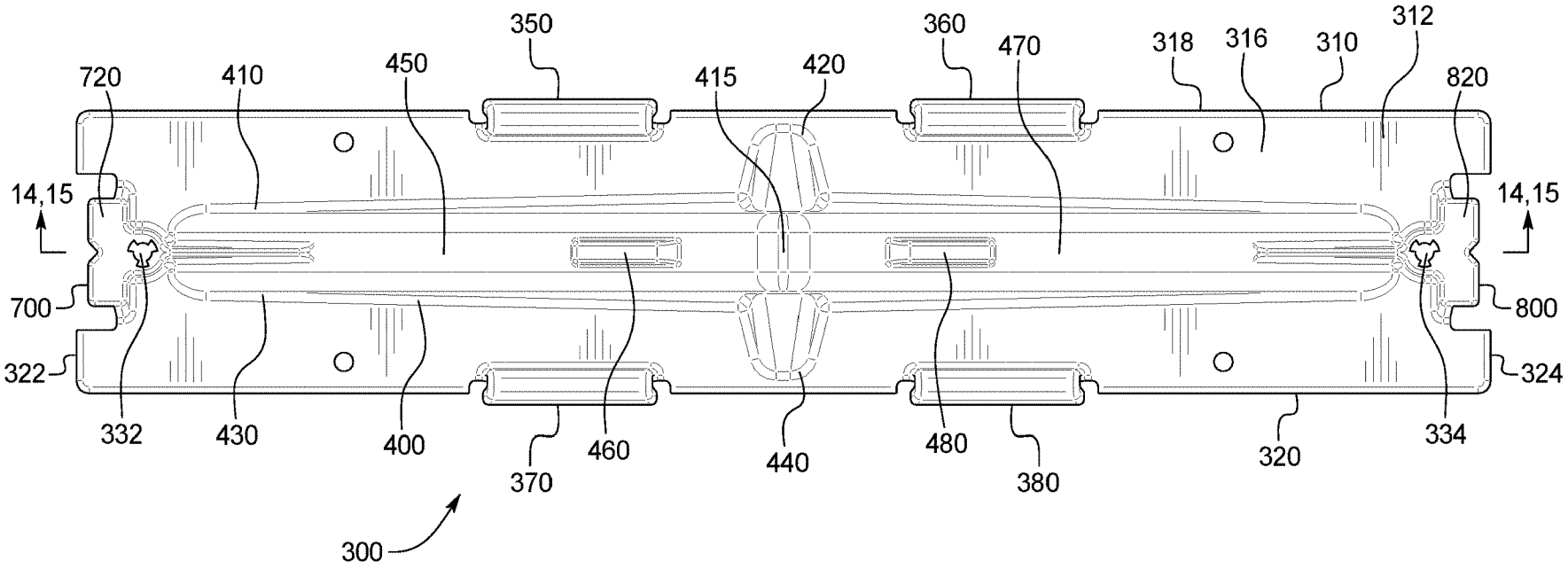
FIG. 12 is a rear view of the load transfer plate pocket of FIG. 6.
Figure 13:
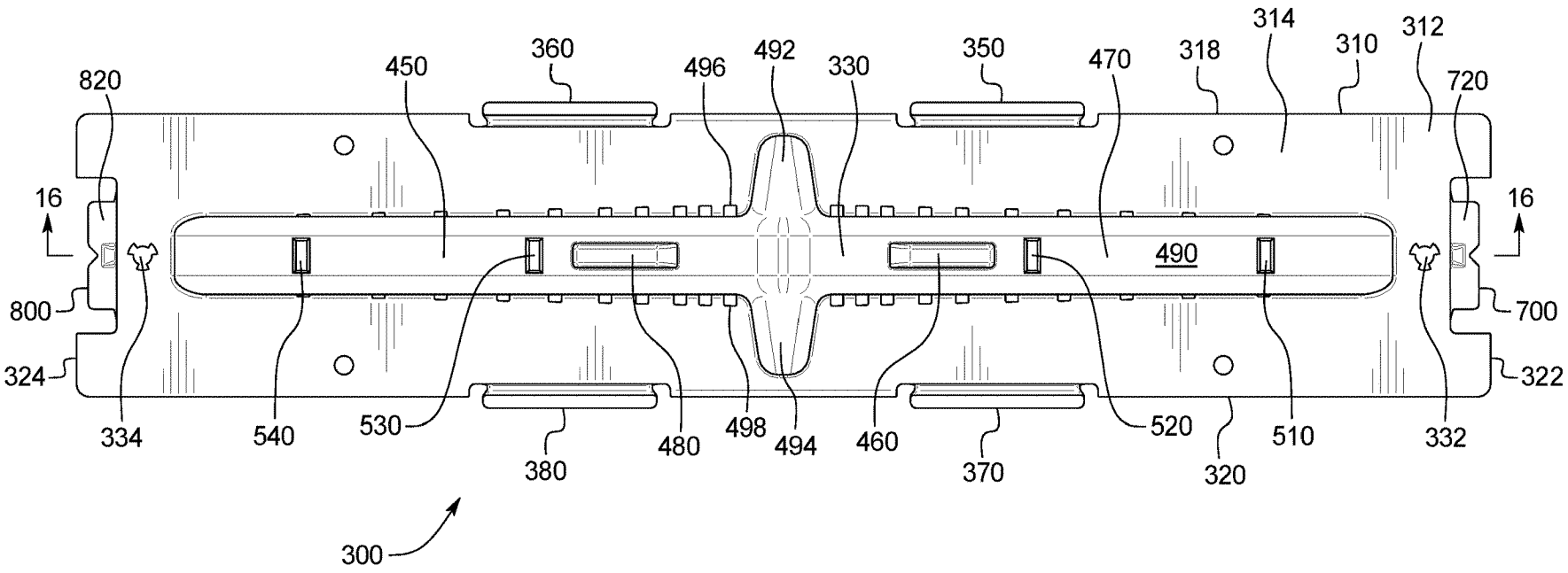
FIG. 13 is a front view of the load transfer plate pocket of FIG. 6.
Figure 14:
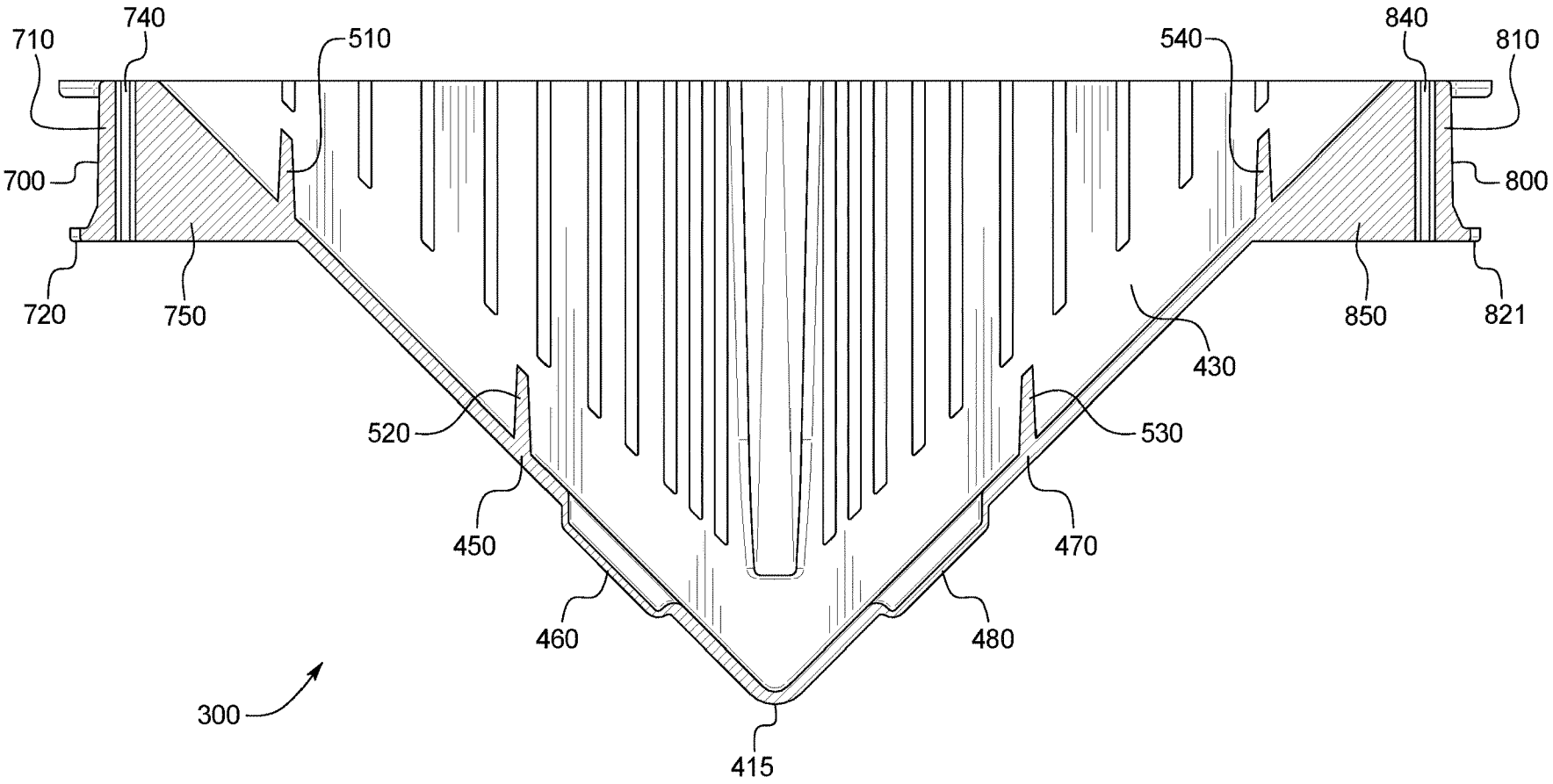
FIG. 14 is a cross-sectional view of the load transfer plate pocket of FIG. 6, taken substantially along line 14-14 of FIG. 12.
Figure 15:
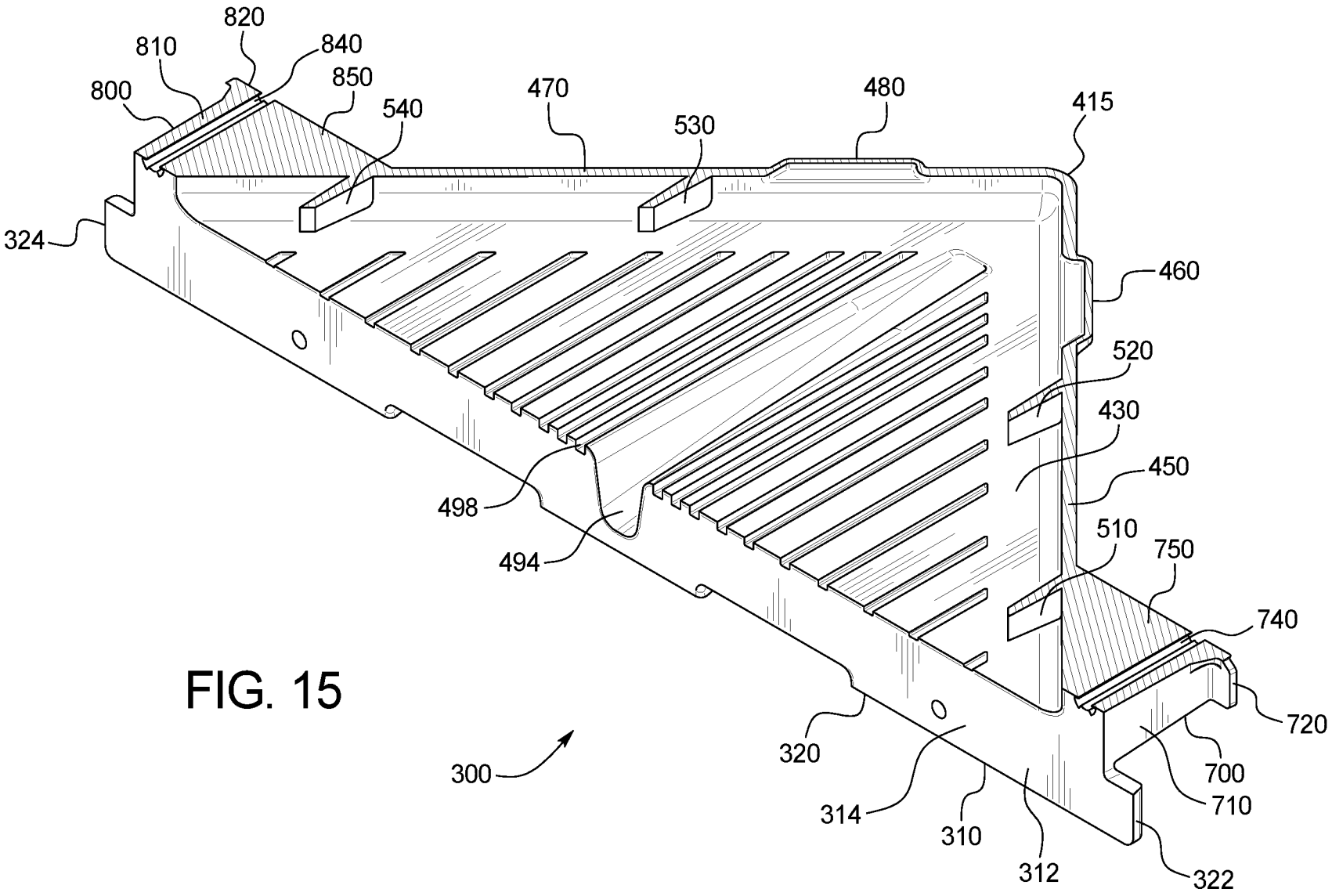
FIG. 15 is a cross-sectional perspective view of the bottom portion of the load transfer plate pocket of FIG. 6, taken substantially along line 15-15 of FIG. 12.
Figure 16:
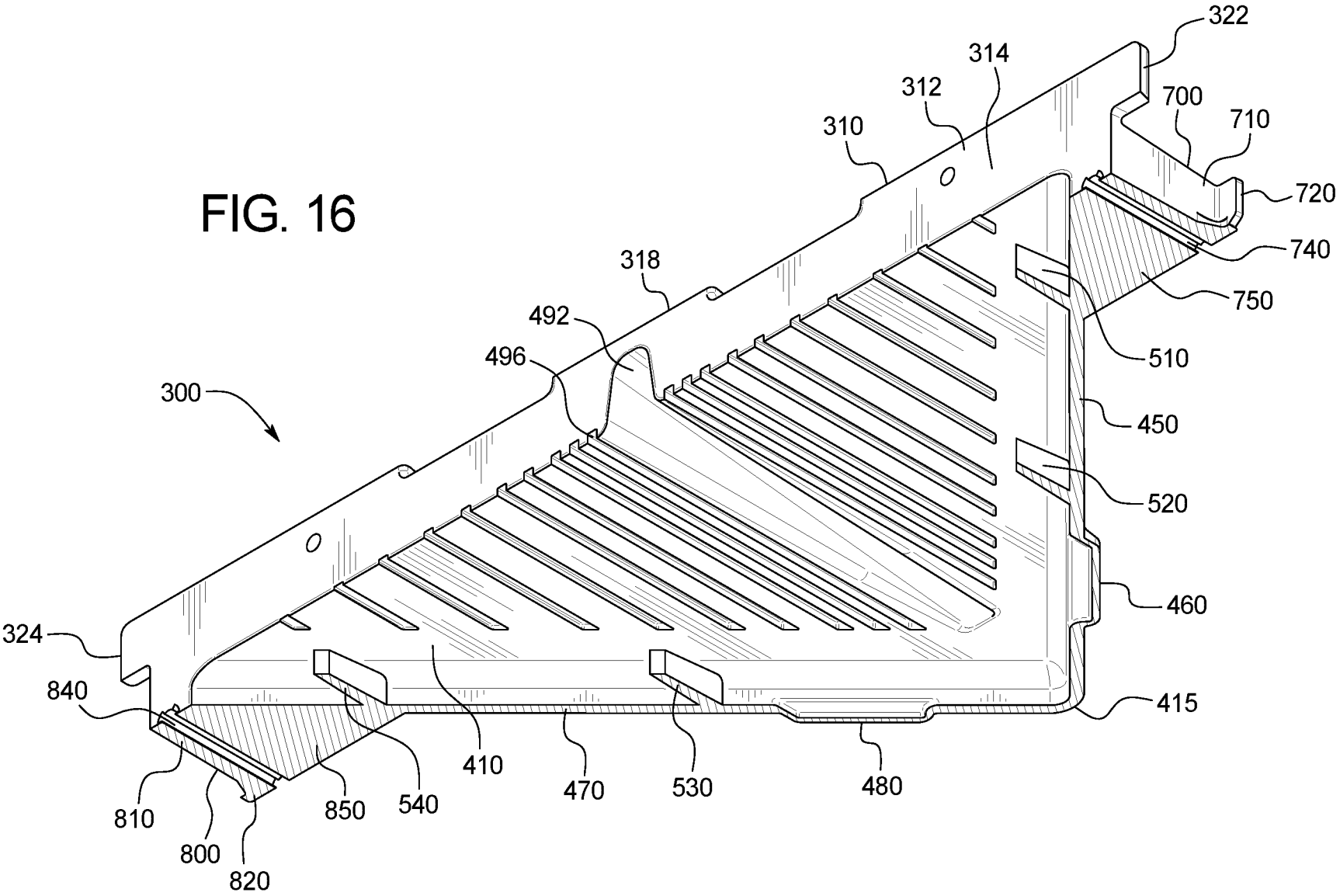
FIG. 16 is a cross-sectional perspective view of the top portion of the load transfer plate pocket of FIG. 6, taken substantially along line 16-16 of FIG. 13.

The four rearwardly extending securing tabs 350, 360, 370, and 380 are identical in this illustrated example embodiment, and thus only tab 350 is discussed in detail herein. It should be appreciated that these securing tabs do not need to be identical in accordance with the present disclosure. As best shown in FIGS. 6, 7, and 10, securing tab 350 includes: (1) a generally straight first section 350*a* integrally formed with, connected to, and extending rearwardly from the back surface 316 of the attachment wall 310); (2) a curved second section 350*b* integrally formed with, connected to, and extending from first section 350*a* upwardly and back toward the back surface 316 of the attachment wall 310; and (3) a third section 350*c* integrally formed with, connected to, and extending forwardly from curved second section 350*b* toward the back surface 316 of the attachment wall 310. This configuration of securing tab 350 (as well as the same configurations for securing tabs 360, 370, and 380) facilitates more secure attachment to and in the concrete slab (such as concrete slab 90). This configuration of securing tab 350 (as well as the same configurations for securing tabs 360, 370, and 380) also facilitates the escape of air from under or around these tabs 350, 360, 370, and 380 during pouring of the concrete and curing of the concrete. It should be appreciated that the securing tabs can be otherwise suitably configured in accordance with the present disclosure. These securing tabs also assist in helping to retain the load transfer plate pocket 300 in concrete when striping the form from the first concrete slab after it is formed and cured. These securing tabs can also be employed for attachment to (steel) forms, and particularly for placement into opening in such (steel) forms.

The body 400 of this illustrated example load transfer plate pocket 300 includes: (a) a generally triangular upper wall 410; (b) a generally triangular lower wall 430; (c) a first side wall 450; (d) a second side wall 470; and (e) a plurality of load transfer plate engagers 510, 520, 530, and 540. The generally triangular upper wall 410, the generally triangular lower wall 430, the first side wall 450, and the second side wall 470 define the interior load transfer plate receiving chamber 490 mentioned above. The interior load transfer plate receiving chamber 490 is configured to slidably receive the load transfer plate during installation and use to account for shrinkage, expansion, contraction, and movement of these components and the concrete slabs in which they are positioned. The load transfer plates and the load transfer plate pockets transfer vertical loads between adjacent concrete slabs as described in U.S. Pat. No. 6,354,760. The upper wall 410, the lower wall 430, the first side wall 450, and the second side wall 470 are formed and connected to minimize air pockets around these walls, and particularly with smooth outer surfaces and with radiused or curved outer edges to enable air adjacent to those members to flow uninterrupted along the outer surfaces of those members and to escape from being trapped under or adjacent to those members.

The upper wall 410 is integrally formed with and extends from the back surface 316 of the body 312 of the attachment wall 310 above the load transfer plate receiving opening 330. The upper wall 410 includes side sections 412 and 414 and a central ramp 420 between the two side sections 412 and 414. The central ramp 420 is integrally formed with, connected to and extend rearwardly from the back surface 316 of the attachment wall 310. The central ramp 420 is tapered downwardly toward the rear edge 415. The central ramp 420 includes smooth outer surfaces and with radiused or curved outer edges. This enables air adjacent to those members to flow uninterrupted along the outer surfaces of those members and to escape from being trapped under or adjacent to those members. The central ramp 420 also helps to dispel air bubbles away from the center of the upper wall 410. The central ramp 420 also helps to improve concrete compaction by minimizing and dispelling the air bubbles in the concrete around the load transfer plate pocket 300 even with little compaction.

The upper wall 400 and in particular the ramp 420 defines an inner central channel 492 that tapers extends downwardly toward the rear edge 415. The upper wall 410 and particularly the side sections 412 and 414 of the upper wall 410 include ridged inner surfaces, with spaced apart rearwardly extending channels such as channel 496. In this illustrated example embodiment, certain channels are spaced apart at different distances. In this illustrated example embodiment, the channels toward the center are spaced apart at closer different distances than the channels toward the sides. These internal structures such as these ridges and channels add structural integrity and strength to this upper wall such that external structural elements (that block the flow of air bubbles) do not need to be added to this upper wall. These internal structures also improve the compressive strength of the load transfer plate pocket 300 by providing additional elements that bear against the vertical face of the forms to better hold the load transfer plate pocket 300 perpendicular to the joint during the concrete pouring. This minimizes the risk of the load transfer plate pocket 300 being dislodge during concrete pouring and reduces the need for re-work and the potential for a misaligned load transfer plate that may cause joint failure.

The lower wall 430 is integrally formed with and extends from the back or back surface 316 of the body 312 of the attachment wall 310 below the load transfer plate receiving opening 330. The lower wall 430 includes side sections 432 and 434 and a central ramp 440 between the two side sections 432 and 434. The central ramp 440 is integrally formed with, connected to and extend rearwardly from the back surface 316 of the attachment wall 310. The central ramp 440 is tapered upwardly toward the rear edge 415. The central ramp 440 includes smooth outer surfaces with radiused or curved outer edges. This enables air adjacent to those members to flow uninterrupted along the outer surfaces of those members and to escape from being trapped under or adjacent to those members. The central ramp 440 also helps to dispel air bubbles away from the center of the lower wall 430. The central ramp 440 also helps to improve concrete compaction by minimizing and dispelling the air bubbles in the concrete around the load transfer plate pocket 300 even with little compaction.

The lower wall 430 and in particular the ramp 440 defines an inner central channel 494 that tapers extends upwardly toward the rear edge 415. The lower wall 430 and particularly the side sections 432 and 434 of the lower wall 430 include ridged inner surfaces, with spaced apart rearwardly extending channels such as channel 498. In this illustrated example embodiment, certain channels are spaced apart at different distances. In this illustrated example embodiment, the channels toward the center are spaced apart at closer different distances than the channels toward the sides. These channels are aligned with the channels in the upper wall 410. These internal structures such as these ridges and channels add structural integrity and strength to this lower wall such that external structural elements (that block the flow of air bubbles) do not need to be added to this lower wall. These internal structures also improve the compressive strength of the load transfer plate pocket 300 by providing additional elements that bear against the vertical face of the forms to better hold the load transfer plate pocket 300 perpendicular to the joint during the concrete pouring. This minimizes the risk of the load transfer plate pocket 300 being dislodged during concrete pouring and reduces the need for re-work and the potential for misaligned load transfer plate that may cause joint failure.

It should be appreciated that in this example embodiment, there are no ribs or other features on the top and bottom faces of the pocket that will catch the air bubbles when moving to the side edges or apex.

It should be appreciated that in this example, the upper and lower walls 410 and 430 are suitably cored to help maintain a uniform wall thickness at the drafted faces preventing warping and sinking.

It should be appreciated that in this example embodiment, the upper and lower walls 410 and 430 each have a suitably large radius with the attachment wall to help prevent entrapment of air bubbles at these corners.

The first side wall 450 is integrally formed with and extends from the back or back surface 316 of the body 312 of the attachment wall 310 adjacent to one side of the load transfer plate receiving opening 330. The first side wall 450 is also integrally formed with and connected to the upper wall 410. The first side wall 450 is also integrally formed with and connected to the lower wall 430. The first side wall 450 includes outwardly extending tab 460 that facilitates central positioning in the cavity during manufacture.

The second side wall 470 is integrally formed with, connected to and extends from the back surface 316 of body 312 of the attachment wall 310 adjacent to the other side of the load transfer plate receiving opening 330. The second side wall 470 is integrally formed with and connected to the upper wall 410. The second side wall 470 is integrally formed with and connected to the lower wall 430. The second side wall 470 is integrally formed with and connected to the first side wall 450 along edge 415. The second side wall 470 includes outwardly extending tab 480 that facilitates central positioning in the cavity during manufacture.

The upper wall 410 and the lower wall 430 are somewhat tapered or draft toward each other from the attachment wall 310 to the rear edge 415. The sections 412 and 414 of the upper wall 410 are respectively tapered or drafted toward the respective side walls 450 and 470. Likewise, the sections 432 and 424 of the lower wall 430 are respectively tapered or drafted toward the respective side walls 450 and 470. This enables air bubbles to rise under the load transfer plate pocket 300 because the air bubbles naturally move towards the highest point until caught or released from the surface. The highest point on the load transfer plate pocket 300 is the edges or the apex of the respective ramp. As air bubbles rise to these points they are dispelled from the load transfer plate pocket 300 and are free to keep moving towards the surface of the concrete. This can be accomplished naturally or with added vibration of the concrete around the load transfer plate pocket 300 to increase the chances of this occurring.

The body 400 of the load transfer plate pocket 300 thus includes multiple tapered outer surfaces and large radiused corners or connections that cause air bubbles to be propelled towards the edges of load transfer plate pocket 300. This enables air adjacent to those members to flow uninterrupted along the outer surfaces of those members and to escape from being trapped under or adjacent to those members. These radiused edges and apexes also minimize perimeter point loads.

The lower wall 430 is spaced apart from the upper wall 410 such that the load transfer plate 100 can freely move in the chamber 490 formed by and between the upper wall 410, the lower wall 430, the first side wall 450, and the second side wall 470. In this illustrated example embodiment the chamber 490 is configured to receive the load transfer plate bracing insert 900, the entire first half or portion 112 of the load transfer plate 100, and part of the second half or portion 114 of the load transfer plate 100 as generally shown in FIG. 18.

More specifically, in various embodiments such as shown in FIG. 18, the width of the load transfer plate receiving chamber 490 of the load transfer plate pocket 300 is greater than the width of the substantially tapered end of the load transfer plate 100 at each corresponding depth along the substantially first tapered half or portion 112 of the load transfer plate 100, such that the substantially first tapered half or portion 112 of the load transfer plate 100 and part of the second half or portion 114 of the load transfer plate 100 can be positioned within the load transfer plate pocket 300 in a direction parallel to the upper surface of the first slab 96. In other words, in this illustrated embodiment, the load transfer plate 100 and the load transfer plate pocket 300 are configured and sized such that: (a) the distance X (as shown in FIG. 5) from the edge 113 to the center line or plane 116 of the load transfer plate 100 is less than (b) the distance from the end edge 415 to the attachment wall 310 of the load transfer plate pocket 300. This configuration enables the load transfer plate 100 to be positioned in the load transfer plate pocket 300 beyond the center line or plane 116 of the load transfer plate 100 such as shown in FIG. 18. This larger load transfer plate pocket 300 also allows for heat caused expansion of the load transfer plate 100.

The present disclosure recognizes that the load transfer plate 100 will generally produce its smallest load per square inch at its widest point. The present disclosure further recognizes that the optimal position for the load transfer plate 100 is thus generally along the vertically extending central plane between the two adjacent concrete slabs 90 and 96. The load transfer plate 100 and the load transfer plate pocket 300 of the present disclosure are thus configured to cause the load transfer plate 100 to be positioned with its widest area along or as close as possible to the vertically extending central plane between the two concrete slabs 90 and 96. The load transfer plate 100 and the load transfer plate pocket 300 of the present disclosure are also configured to enable the load transfer plate 100 to move with and as the central plane between the two concrete slabs 90 and 96 moves.

The load transfer plate pocket 300 includes load transfer plate engagers 510 and 520 that are integrally connected to and extend inwardly from the inner surface of the first side wall 450 toward the attachment wall 310. The load transfer plate engagers 510 and 520 in this illustrated embodiment are flexible and thus bend when the load transfer plate 100 moves further into or expands further into the chamber 900 under sufficient pressure.

The load transfer plate pocket 300 also includes load transfer plate engagers 530 and 540 that are integrally connected to and extend inwardly from the inner surface of the second side wall 470 toward the attachment wall 310. The load transfer plate engagers 530 and 540 are flexible and thus bend when the load transfer plate 100 further moves into the chamber 490 under sufficient pressure.

The plurality of load transfer plate engagers 510, 520, 530, and 540 thus account for the situation where the concrete slabs are made from a concrete that first expands before it contracts. In such case, the plurality of load transfer plate engagers 510, 520, 530, and 540 in this illustrated embodiment allow for such expansion and movement of the load transfer plate 100 further into the load transfer plate pocket 300 (i.e., into the interior chamber 490 of the pocket 300). The plurality of load transfer plate engagers 510, 520, 530, and 540 in this illustrated embodiment also allow for heat expansion of the load transfer plate 100 itself. In certain embodiments, one or more of the load transfer plate engagers 510, 520, 530, and 540 can be configured to break off from the side walls of the load transfer plate pocket 300. It should be appreciated that the quantity of load transfer plate engagers can vary in accordance with the present disclosure.

The fastener receivers 700 and 800 are identical in this illustrated example embodiment. It should be appreciated that these fastener receivers do not need to be identical in accordance with the present disclosure. The channel 740 is aligned with the opening 332 in the attachment wall 310.

The fastener receiver 700 includes: (1) a generally straight first section 710 integrally formed with, connected to, and extending rearwardly from the back surface 316 of the attachment wall 310); (2) a second section or tab 720 integrally formed with, connected to, and extending outwardly from first section 710; and (3) a third section 750 integrally formed with, connected to, and extending from the first section 710 toward the side wall 450 and integrally formed with and connected to the side wall 450. The second section or tab 720 defines a string-line notch (not labeled). The third section 750 defines a channel 740 configured to receive a fastener. The channel 740 is aligned with the opening 332 in the attachment wall 310. The third section 750 may include one or more fastener gripping members (not labeled) that assist in maintaining the fastener in the channel 740 during installation.

Likewise, the fastener receiver 800 includes: (1) a generally straight first section 810 integrally formed with, connected to, and extending rearwardly from the back surface 316 of the attachment wall 310); (2) a second section or tab 820 integrally formed with, connected to, and extending outwardly from first section 810; and (3) a third section 850 integrally formed with, connected to, and extending from the first section 810 toward the side wall 470 and integrally formed with and connected to the side wall 470. The second section or tab 820 defines a string-line notch (not labeled). The third section 850 defines a channel 840 configured to receive a fastener. The channel 840 is aligned with the opening 334 in the attachment wall 310. The third section 850 may include one or more fastener gripping members (not labeled) that assist in maintaining the fastener in the channel 840 during installation.

The load transfer plate bracing insert 900 in this illustrated example embodiment is generally L-shaped and includes two connected legs 910 and 920. The legs 910 and 920 are configured such that they are engaged by the first outer edge 140 and the second outer edge 150 of the load transfer plate 100. In this illustrated example embodiment, the bracing insert 900 is made from a suitable metal, but can be made from other suitable materials. In this illustrated example embodiment, the load transfer plate bracing insert 900 includes opposing upwardly and downwardly extending pins that are configured to extend into the aligned plurality of spaced apart channels of the upper wall and the plurality of spaced apart channels of the lower wall. For example, the load transfer plate bracing insert 900 includes a plurality of top upwardly extending pins 915*a* to 915*g* and bottom downwardly extending pins (not labeled) that are configured to extend into the aligned channels defined by the upper and lower walls to guide the load transfer plate bracing insert 900 into the chamber 490.

FIGS. 17 and 18 generally illustrate how the load transfer plate 100 and load transfer plate pocket 300 optimize the position of the load transfer plate 100 between the adjacent concrete slabs 90 and 96 during installation and when the adjacent concrete slabs 90 and 96 shrink and have moved away from each other an expected distance during the curing process or otherwise (subsequently to curing). More specifically, FIG. 18 shows two adjacent cast-in-place concrete slabs 90 and 96 before such concrete slabs 90 and 96 have substantially cured and separated, and with the load transfer plate 100 positioned in the load transfer plate pocket 300 for installation such that the entire first half or portion 112 of the load transfer plate 100 and part of the second half or portion 114 of the load transfer plate 100 is in the load transfer plate pocket 300. At this point in time, the load transfer plate 100 is not positioned at the optimal position for transferring loads between the two adjacent cast-in-place concrete slabs 90 and 96.

As indicated or mentioned above, the present disclosure further provides a method of installing the load transfer plate pocket 300 and the load transfer plate 100 for transferring loads between a first cast-in-place concrete slab 90 and a second cast-in-place concrete slab 96. In various embodiments, the method includes the steps of: (1) placing an edge form on the ground or other suitable substrate; (2) attaching a load transfer plate pocket 300 to the edge form such that part of the load transfer plate pocket 300 extends into the area where the first concrete slab 90 will be formed; (3) pouring the concrete material which forms the first concrete slab 90; (4) allowing the first concrete slab 90 to cure or harden to a certain degree; (5) removing the edge form from the first concrete slab 90 such that the load transfer plate pocket 300 remains within and attached to the first concrete slab 90; (6) inserting a load transfer plate bracing insert 900 into the load transfer plate pocket; (7) inserting the first portion 112 of the load transfer plate 100 substantially into the load transfer plate pocket 300 such that the second portion 114 of the load transfer plate 100 is also partially in the load transfer plate pocket 300 and protrudes into a second area where the second concrete slab 96 will be formed; (8) pouring the concrete material that forms the second cast-in-place concrete slab 96 into the second area where the second concrete slab 96 will be formed; and (9) allowing the second concrete slab 96 to cure or harden. This method enables the load transfer plate 100 and the load transfer plate pocket 300 to be configured to enable the load transfer plate 100 to move with and as the central plane between the two concrete slabs 90 and 96 moves. This method also enables the load transfer plate 100 to be positioned with its widest area along or as close as possible to the vertically extending central plane between the two concrete slabs 90 and 96. It should be appreciated that in various embodiments, the load transfer plate bracing insert can be It should be appreciated that the load transfer plate pocket can be provided with the fasteners positioned in the fastener channels, and with the load transfer plate bracing insert in the chamber, and with direction tape positioned on the opening in the attachment member.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving opening; and a body fixedly connected to and extending rearwardly from the attachment wall, the body including:

(a) a triangular upper wall including an upwardly extending upper central ramp that defines an upwardly extending part of the load transfer plate receiving opening;

(b) a triangular lower wall including a downwardly extending lower central ramp that defines a downwardly extending part of the load transfer plate receiving opening, the lower wall spaced apart from the upper wall;

(c) a first side wall fixedly connected to the upper wall and to the lower wall and fixedly connecting the upper wall to the lower wall; and (d) a second side wall fixedly connected to the upper wall and to the lower wall, and fixedly connecting the upper wall to the lower wall, wherein the upper wall, the lower wall, the first side wall, and the second side wall define a transfer plate receiving chamber.

2. The load transfer plate pocket of claim 1, wherein the attachment wall includes a plurality of rearwardly extending securing tabs.

3. The load transfer plate pocket of claim 2, wherein each securing tab includes a first section connected to and extending rearwardly from a back surface of the attachment wall, a curved second section connected to and extending from the first section toward the back surface of the attachment wall, and a third section connected to and extending forwardly from the curved second section toward the back surface of the attachment wall.

4. The load transfer plate pocket of claim 1, wherein the upper wall includes a first section extending from the upper central ramp to the first side wall and a second section extending from the upper central ramp the second side wall, wherein the lower wall includes a first section extending from the lower central ramp to the first side wall and a second section extending from the lower central ramp the second side wall, wherein the first section of the upper wall and the first section of the lower wall converge toward the first side wall, and wherein the second section of the upper wall and the second section of the lower wall converge toward the second side wall.

5. The load transfer plate pocket of claim 1, wherein the upper wall includes a plurality of spaced apart inner ridges and defines a plurality of spaced apart channels.

6. The load transfer plate pocket of claim 5, wherein the lower wall includes a plurality of spaced apart inner ridges and defines a plurality of spaced apart channels.

7. The load transfer plate pocket of claim 6, wherein the plurality of spaced apart channels of the upper wall and the plurality of spaced apart channels of the lower wall are aligned and configured to receive opposing pins of a load transfer plate bracing insert.

8. The load transfer plate pocket of claim 1, which includes first and second fastener receivers.

9. The load transfer plate pocket of claim 8, wherein: (a) the first fastener receiver includes a first section connected to and extending rearwardly from a back surface of the attachment wall, a second section connected to and extending outwardly from the first section, and a third section connected to and extending from the first section toward the first side wall and connected to the first side wall, wherein the third section defines a first channel configured to receive a fastener; and (b) the second fastener receiver includes a first section connected to and extending rearwardly from the back surface of the attachment wall, a second section connected to and extending outwardly from the first section, and a third section connected to and extending from the first section toward the second side wall and connected to the second side wall, wherein the third section defines a second channel configured to receive a fastener.

10. The load transfer plate pocket of claim 1, which is configured and sized such that the load transfer plate can be positioned in the load transfer plate chamber beyond a center line of the load transfer plate.

11. The load transfer plate pocket of claim 1, wherein each of the upper central ramp and the lower central ramp have smooth rounded outer surfaces.

12. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving opening, wherein the attachment wall includes a plurality of rearwardly extending securing tabs, wherein each securing tab includes a first section connected to and extending rearwardly from the attachment wall, a curved second section connected to and extending from the first section toward the attachment wall, and a third section connected to and extending forwardly from the curved second section toward the attachment wall;

a body extending from the attachment wall, the body including:

(a) an upper wall including an upper central ramp;

(b) a lower wall including a lower central ramp, the lower wall spaced apart from the upper wall;

(c) a first side wall connected to the upper wall and to the lower wall; and (d) a second side wall connected to the upper wall, the lower wall, and the first side wall, wherein the upper wall, the lower wall, the first side wall, and the second side wall define a transfer plate receiving chamber;

a first fastener receiver extending rearwardly from a back surface of the attachment wall; and a second fastener receiver extending rearwardly from the back surface of the attachment wall.

13. The load transfer plate pocket of claim 12, wherein for each securing tab, the first section is connected to and extends rearwardly from the back surface of the attachment wall, the curved second section is connected to and extends from the first section toward the back surface of the attachment wall, and the third section is connected to and extends forwardly from the curved second section toward the back surface of the attachment wall.

14. The load transfer plate pocket of claim 13, wherein: (a) the first fastener receiver includes a first section connected to and extending rearwardly from the back surface of the attachment wall, a second section connected to and extending outwardly from the first section, and a third section connected to and extending from the first section toward the first side wall and connected to the first side wall, wherein the third section defines a first channel configured to receive a fastener; and (b) the second fastener receiver includes a first section connected to and extending rearwardly from the back surface of the attachment wall, a second section connected to and extending outwardly from the first section, and a third section connected to and extending from the first section toward the second side wall and connected to the second side wall, wherein the third section defines a second channel configured to receive a fastener.

15. The load transfer plate pocket of claim 12, wherein: (a) the first fastener receiver includes a first section connected to and extending rearwardly from the back surface of the attachment wall, a second section connected to and extending outwardly from the first section, and a third section connected to and extending from the first section toward the first side wall and connected to the first side wall, wherein the third section defines a first channel configured to receive a fastener; and (b) the second fastener receiver includes a first section connected to and extending rearwardly from the back surface of the attachment wall, a second section connected to and extending outwardly from the first section, and a third section connected to and extending from the first section toward the second side wall and connected to the second side wall, wherein the third section defines a second channel configured to receive a fastener.

16. The load transfer plate pocket of claim 12, wherein each of the upper central ramp and the lower central ramp have smooth rounded outer surfaces.

17. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving opening; and a body extending from the attachment wall, the body including:

(a) an upper wall including an upper central ramp and a plurality of spaced apart upper inner ridges that define a plurality of spaced apart upper channels, at least two of the plurality of spaced apart upper channels having different lengths, and (b) a lower wall including a lower central ramp and a plurality of spaced apart lower inner ridges that define a plurality of spaced apart lower channels, wherein the lower wall is spaced apart from the upper wall, at least two of the plurality of spaced apart lower channels having different lengths, and wherein the upper and lower channels are configured to receive opposing pins of a load transfer plate bracing insert before insertion of the load transfer plate into the load transfer plate receiving opening;

(c) a first side wall connected to the upper wall and to the lower wall; and (d) a second side wall connected to the upper wall, the lower wall, and the first side wall, wherein the upper wall, the lower wall, the first side wall, and the second side wall define a transfer plate receiving chamber.

18. The load transfer plate pocket of claim 17, wherein the attachment wall includes a plurality of rearwardly extending securing tabs, wherein each securing tab includes a first section connected to and extending rearwardly from a back surface of the attachment wall, a curved second section connected to and extending from the first section toward the back surface of the attachment wall, and a third section connected to and extending forwardly from the curved second section toward the back surface of the attachment wall.

19. The load transfer plate pocket of claim 18, which includes first and second fastener receivers, wherein: (a) the first fastener receiver includes a first section connected to and extending rearwardly from a back surface of the attachment wall, a second section connected to and extending outwardly from the first section, and a third section connected to and extending from the first section toward the first side wall and connected to the first side wall, wherein the third section defines a first channel configured to receive a fastener; and (b) the second fastener receiver includes a first section connected to and extending rearwardly from the back surface of the attachment wall, a second section connected to and extending outwardly from the first section, and a third section connected to and extending from the first section toward the second side wall and connected to the second side wall, wherein the third section defines a second channel configured to receive a fastener.

20. The load transfer plate pocket of claim 17, wherein each of the upper central ramp and the lower central ramp have smooth rounded outer surfaces.

21. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving opening, the attachment wall including a plurality of rearwardly extending securing tabs, each securing tab includes a first section connected to and extending rearwardly from the attachment wall, a curved second section connected to and extending from the first section toward the attachment wall, and a third section connected to and extending forwardly from the curved second section toward the attachment wall; and a body extending from the attachment wall, the body including:

(a) an upper wall including an upper central ramp that defines part of the load transfer plate receiving opening;

(b) a lower wall including a lower central ramp that defines part of the load transfer plate receiving opening, the lower wall spaced apart from the upper wall;

(c) a first side wall connected to the upper wall and to the lower wall; and (d) a second side wall connected to the upper wall, the lower wall, and the first side wall, wherein the upper wall, the lower wall, the first side wall, and the second side wall define a transfer plate receiving chamber.

22. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving opening; and a body fixedly connected to and extending rearwardly from the attachment wall, the body including:

(a) a triangular upper wall including an upwardly extending upper central ramp having a smooth rounded outer surfaces with curved outer edges;

(b) a triangular lower wall including a downwardly extending lower central ramp having a smooth rounded outer surfaces with curved outer edges, the lower wall spaced apart from the upper wall;

(c) a first side wall fixedly connected to the upper wall and to the lower wall and fixedly connecting the upper wall to the lower wall; and (d) a second side wall fixedly connected to the upper wall and to the lower wall, and fixedly connecting the upper wall to the lower wall, wherein the upper wall, the lower wall, the first side wall, and the second side wall define a transfer plate receiving chamber.

23. The load transfer plate pocket of claim 22, wherein the upper wall includes a first section extending from the upper central ramp to the first side wall and a second section extending from the upper central ramp the second side wall, wherein the lower wall includes a first section extending from the lower central ramp to the first side wall and a second section extending from the lower central ramp the second side wall, wherein the first section of the upper wall and the first section of the lower wall converge toward the first side wall, and wherein the second section of the upper wall and the second section of the lower wall converge toward the second side wall.

24. A load transfer plate pocket configured to receive a load transfer plate for transferring loads across a joint between a first cast-in-place concrete slab and a second cast-in-place concrete slab, the load transfer plate pocket comprising:

an attachment wall defining a load transfer plate receiving opening, wherein the attachment wall includes a plurality of rearwardly extending securing tabs;

a body extending from the attachment wall, the body including:

(a) an upper wall including an upper central ramp;

(b) a lower wall including a lower central ramp, the lower wall spaced apart from the upper wall;

(c) a first side wall connected to the upper wall and to the lower wall; and (d) a second side wall connected to the upper wall, the lower wall, and the first side wall, wherein the upper wall, the lower wall, the first side wall, and the second side wall define a transfer plate receiving chamber;

a first fastener receiver extending rearwardly from a back surface of the attachment wall, the first fastener receiver including a first section connected to and extending rearwardly from the back surface of the attachment wall, a second section connected to and extending outwardly from the first section, and a third section connected to and extending from the first section toward the first side wall and connected to the first side wall, wherein the third section defines a first channel configured to receive a fastener; and a second fastener receiver extending rearwardly from the back surface of the attachment wall, the second fastener receiver including a first section connected to and extending rearwardly from the back surface of the attachment wall, a second section connected to and extending outwardly from the first section, and a third section connected to and extending from the first section toward the second side wall and connected to the second side wall, wherein the third section defines a second channel configured to receive a fastener.

* * * * *